US006122843A

United States Patent [19]

Noguchi et al.

[11] Patent Number: 6,122,843

[45] Date of Patent: Sep. 26, 2000

[54] DRUM WASHER-DRIER WITH REDUCED VIBRATION TO A MOUNTING FLOOR

[75] Inventors: Takeo Noguchi; Masaru Ando, both of Osaka, Japan

[73] Assignee: Sharp Kabushiki Kaisha, Osaka, Japan

[21] Appl. No.: 09/267,345

[22] Filed: Mar. 15, 1999

Related U.S. Application Data

[62] Division of application No. 08/791,137, Jan. 30, 1997, Pat. No. 5,906,056.

[30] Foreign Application Priority Data

| | | | |
|---|---|---|---|
| Jan. 31, 1996 | [JP] | Japan | 8-015216 |
| Mar. 28, 1996 | [JP] | Japan | 8-073821 |
| Jan. 27, 1997 | [JP] | Japan | 9-012362 |

[51] Int. Cl.[7] ..... F26B 11/02

[52] U.S. Cl. ..... 34/596; 34/602; 68/23.3

[58] Field of Search ..... 34/595, 596, 602, 34/318, 322, 323; 68/12.06, 19.2, 20, 23.1, 23.3, 25, 139, 140

[56] References Cited

U.S. PATENT DOCUMENTS

| | | | |
|---|---|---|---|
| 3,297,284 | 1/1967 | Pellerin . | |
| 4,974,339 | 12/1990 | Kawamura et al. | 34/73 |
| 5,000,015 | 3/1991 | Nakamura et al. | 68/23.3 |
| 5,117,659 | 6/1992 | Sharp et al. . | |
| 5,207,764 | 5/1993 | Akabane et al. . | |
| 5,345,792 | 9/1994 | Farrington et al. | 68/23.3 |
| 5,582,040 | 12/1996 | Khan | 68/23.2 |
| 5,709,109 | 1/1998 | Cho | 68/23.2 |
| 5,839,297 | 11/1998 | Swint | 68/12.06 |
| 5,870,907 | 2/1999 | Cho | 68/23.1 |
| 5,906,020 | 5/1999 | Swint | 8/159 |

FOREIGN PATENT DOCUMENTS

| | | |
|---|---|---|
| 2026844 | 4/1991 | Canada . |
| 0381765A1 | 12/1989 | European Pat. Off. . |
| 0403042A1 | 12/1990 | European Pat. Off. . |
| 0421442 | 4/1991 | European Pat. Off. . |
| 0607678 | 7/1994 | European Pat. Off. . |
| 1213067 | 3/1960 | France . |
| 2393097 | 12/1978 | France . |
| 1912481 U | 10/1970 | Germany . |
| 2746989 | 4/1978 | Germany . |
| 56158692 | 12/1956 | Japan . |
| 3-297492 | 12/1991 | Japan . |
| 4-240488 | 8/1992 | Japan . |
| 4-332596 | 11/1992 | Japan . |
| 6134178 | 5/1994 | Japan . |
| 7124378 | 5/1995 | Japan . |
| 9415033 | 7/1994 | Rep. of Korea . |
| 75206593 | 4/1976 | Taiwan . |
| 79107230 | 7/1991 | Taiwan . |
| 83102496 | 6/1995 | Taiwan . |
| 1598399 | 9/1981 | United Kingdom . |

*Primary Examiner*—Stephen Gravini

[57] ABSTRACT

Drum washer-drier includes a drum rotating about a horizontal rotary axis, a water tank including drum, and outer tank resiliently supporting water tank. A plurality of suspending rods are suspended from an upper inner surface of outer tank, and water tank is resiliently supported by providing compression springs between spring receiving portions at lower ends of suspending rods and support receiving portions of water tank. Further, a damper generating a sliding resistance as the spring is expanded/compressed is provided at the lower end portion of suspending rod. At the time of dehydration, drum is rotated for a prescribed time period at a rotation speed higher than critical rotation speed of a fluid balancer but lower than a resonance rotation speed caused by resilient support, and thereafter high speed rotation starts. A structure for protecting the fluid balancer formed of synthetic resin during drying is also provided.

12 Claims, 18 Drawing Sheets

DRUM WASHER-DRIER WITH REDUCED VIBRATION TO A MOUNTING FLOOR

This application is a divisional of application Ser. No. 08/791,137, filed on Jan. 30, 1997, U.S. Pat. No. 5,906,056, the entire contents of which are hereby incorporated by reference.

BACKGROUND OF THE INVENTION

1. Field of the Invention

The present invention relates to an apparatus for dehydrating and drying by rotating a drum about an approximately horizontal rotary axis such as a drum drier or a drum washer-drier. More specifically, the present invention relates to a method and mechanism for reducing vibration of the drum drier or the drum washer.

2. Description of the Background Art

A drum washer-drier performing washing to drying by a single drum has been known. A representative drum washer-drier has such a structure in that the drum rotates about a horizontal axis in a water tank, and functions from washing, rinsing, dehydration to drying can be performed by the single drum.

Structure of a conventional drum washer-drier will be described in the following. FIGS. 19 and 20 show a first example of the prior art. Referring to FIGS. 19 and 20, the conventional drum washer-drier includes a drum 171 having a number of small holes 2 for receiving and rotating laundry, and a water tank 3 enclosing drum 171. At the central portion of water tank 3, a horizontal rotary axis 4 having one end fixed at the center of drum 171 is rotatably supported. At the other end of rotary axis 4, a drum pulley 5 is fixed. A driving motor 6 is attached to the lower surface of water tank 3, and a motor pulley 7 provided on the rotary axis of driving motor 6 is operatively coupled to drum pulley 5 by means of a belt 8. Water tank 3 is held in an outer tank 9. Water tank 3 is resiliently supported in outer tank 9 by means of a plurality of tension springs 30 suspended from an internal upper surface of the box of outer body 9. Further, water tank 3 is held by a plurality of dampers 31 provided between the lower portion thereof and an inner bottom of external box of outer tank 9. Vibration of water tank 3 is attenuated by tension spring 30 and dumper 31.

A fluid balancer 122 is fixed on the periphery at a front surface of drum 171, so as to reduce vibration at the time of dehydration. As means for reducing vibration at the time of dehydration, provision of a weight on a front side surface of water tank 3 has been known, other than fluid balancer attached to drum 171.

At a front surface of outer tank 9, there is a door 16 for putting laundry in. Between water tank 3 and outer tank 9 at this portion, a bellows type door packing 17 is provided and when door 16 is closed, the inside of water tank 3 comes to be water tight, because of the door packing 17. At the bottom surface of external box of outer tank 9, there are a plurality of legs 20 for supporting the washer as a whole on a floor. At a lower portion of water tank 3, a drain valve 19 for draining water at the time of dehydration is provided. Further, there are drying air duct 241 for guiding drying air to water tank 3, a drying heater 214 provided in drying air duct 241, and a heat exchanger for 215 for removing moisture arranged on drying air duct 241. Motor 6, drain valve 19, a water feed valve, not shown, heater 214 and the like are all controlled by a control circuit 118 for controlling operations in various steps. Further, on an inner peripheral surface of drum 171, there is provided a buffer 21 for tumbling, which will be described later.

Another example of a conventional drum washer-drier is shown in FIG. 21. In this figure, portions corresponding to those of FIGS. 19 and 20 are denoted by the same reference characters. These have similar functions. Therefore, detailed description thereof will not be repeated.

In the example shown in FIG. 21, water tank 3 is resiliently supported on the inner portion of outer tank 9 by means of a plurality of antivibration legs 31 each including a compression spring and a damper. Antivibration leg 33 is fixed on the lower portion of water tank 3 and on the bottom surface of the box of outer tank 9, with antivibration rubber 34 interposed.

These conventional drum washer-driers operate in the following manner.

In the step of washing, laundry and water are put in drum 171, and drum 171 is rotated at a low speed by driving motor 6. Laundry in drum 171 is lifted up by a baffle 21 by the rotation of drum 171 and falls by the weight of itself (hereinafter, this operation will be referred to as "tumbling"), and washing is performed by the mechanical force thereof.

In the step of dehydration, first, water is drained by opening drain valve 19. Thereafter, drum 171 is rotated at a high speed about the horizontal rotary axis, water in the laundry is removed by centrifugal force, and the water is further removed out from drum 171 through small holes 2. At that time, because of bias of the laundry in drum 171, vibrating body including drum 171, driving motor 6 and water tank 3 vibrates, and reduction of this vibration is a problem. In the washer having fluid balancer 122 such as shown in FIGS. 19 to 21, fluid balancer 122 functions in the following manner. A prescribed amount of fluid is sealed in fluid balancer 122. When the number of rotation of drum 171 exceeds a resonance rotation number, the fluid immediately moves to the other side of the biased portion causing imbalance, adjusting balance. Thus vibration at the time of dehydration caused by imbalance of laundry can be prevented.

For washers which do not have a fluid balancer, a weight may be provided on water tank 3, as already mentioned. The weight reduces vibration of the vibrating body caused by bias of the laundry. However, the weight is of considerable weight, e.g. about 16 kg. Consequently, the weight of the vibrating body as a whole is so increased that it becomes necessary to make the structure of outer tank 9 robust. This leads to increase in weight of the product as a whole (heavier than 80 kg), and handling of the product during delivery becomes troublesome. Further, depending on the structure of houses, it may be necessary to reinforce the floor so that it can withstand the weight of the drum washer-drier at the time of installation. This is the reason why attenuation of vibration using fluid balancer has been adopted as a preferable measure.

As for the step of drying, air heated by heater 214 is fed to drum 171 to drying air duct 241, while the laundry is tumbled with the moisture removed by heat exchanger 215.

In the drum washer-drier shown in FIGS. 19 and 20, drum 171 rotates about horizontal rotary axis 4. Therefore, sometimes, water tank 3 vibrates considerably because of bias of laundry in drum 171. The vibration of water tank 3 is transmitted to the body of outer tank 9, that is, the washer as a whole, through tension springs 30. The magnitude of transmitted force at that time is in proportion to spring constant of tension springs 30. In order to reduce vibration transmitted to the washer as a hole, spring constant of tension spring 30 should be made smaller. However, spring constant of tension spring 30 has the following restriction.

When water is held in water tank 3, water tank 3 lowers against tensile force of tension spring 30. The amount of lowering is in inverse proportion to the spring constant of tension spring 30. The amount of lowering of water tank 3 is limited because of the dimension or specification of the product, and it cannot exceed a certain value. Therefore, spring constant of spring 30 cannot be set smaller than a prescribed value because of the limit. Accordingly, vibration of water tank 3 is transmitted to the washer as a whole with considerable vibration transmitting force, so that the floor itself vibrates. In the worst case, the house would eventually vibrate because of the vibration of the washer, causing problems of noise and dissatisfaction of the user.

In the drum washer-drier shown in FIG. 21, water tank 3 is not lifted by tension spring. Therefore, there is not the limit imposed by the spring constant of tension spring. In this type of washer, the problem is spring constant of antivibration rubber 34. In the example shown in FIG. 21, when the spring constant of antivibration rubber 34 is reduced to some extent, transmission of vibration of water tank 3 to outer tank 9 can be reduced. However, the spring constant of antivibration rubber 34 has the following restriction.

In the example shown in FIG. 21, when vibration is caused by bias of laundry, water tank 3 vibrates not only in the upper and lower directions but also left and right as well as front and rear directions. Antivibration rubber 34 prevents all these vibrations. However, in that case, load not only in the compressing direction but also in the shearing direction are imposed on antivibration rubber 34. In order to prevent breakage of antivibration rubber 34 by shear load, the hardness of antivibration rubber 34 should be extremely high. However, this increases spring constant of antivibration rubber 34. This results in much transmission force of vibration to the floor.

Japanese Patent Laying-Open No. 56-158692 proposes a solution of the problem of the prior art shown in FIGS. 19 and 20. Outline of the disclosure of Japanese Patent Laying-Open No. 56-158692 is shown in FIG. 22. Referring to FIG. 22, the washer-drier includes a plurality of rods 704 suspended from a lower portion of an upper surface of outer tank 9 and each having a spring receiving portion 710 at a lower tip end; a suspending fitting 706 fixed on water tank 3; a lower slider 712 fitted with suspended fitting 706 and having an opening through which the lower end of the rod 704 is slidably inserted; and a compression spring 708 for preventing vibration fitted between suspended fitting 706 and spring receiving portion 710 at the lower tip end of rod 704. Rod 704 is supported by an upper slider 702 at its upper end, which upper slider has a spherical portion conforming to a corner plate having a spherical portion formed at the lower portion of the upper surface of outer tank 9. In FIG. 22, same portions as those shown in FIGS. 19 and 20 are denoted by the same reference characters. The functions are the same. Therefore, detailed description thereof is not repeated here.

As shown in FIG. 22, in this example, water tank 3 is resiliently supported by rod 704, compression spring 708 and suspended fitting 706, and vibration is attenuated by further providing a damper 31 at a lower portion, besides spring 708. In this structure, when the water fed to water tank 3 increases, compression spring 708 is compressed gradually, and if the water exceeds a certain amount, the spring attains fully compressed state. At that time, water tank 3 is directly supported by rod 704 and suspended fitting 706, and it does not go lower than that position, even when spring 708 has small spring constant. Accordingly, the spring constant of spring 708 can be made smaller than in the prior art examples shown in FIGS. 19 and 20.

In such an example, an isolated and independent dumper 31 is provided between water tank 3 and inner bottom of outer tank 9. Therefore, vibration of water tank 3 is transmitted to outer tank 9 through the dumper, and directly to the floor through legs 20. Therefore, sufficient reduction of vibration transmitted to the floor cannot be realized.

Another problem related to vibration in the step of drying in the conventional washer is as follows. In the conventional drum washer-drier having fluid balancer 122 such as shown in FIGS. 19 and 20, in the step of drying, heated air is fed to water tank 3 through drying air duct 241 while drum 171 is rotated at a low speed, so as to dry the laundry in drum 171. At this time, fluid sealed in fluid balancer 122 rotating about the horizontal axis is distributed in fluid balancer 122 by centrifugal force when the number of rotation exceeds a prescribed number, imposing load in radial direction to fluid balancer 122, while it stay at a lower portion when rotation speed is low, imposing load on fluid balancer 122 in gravity direction.

As is well known, fluid balancer 122 is generally formed of a synthetic resin. Change in temperature during the step of drying may soften the synthetic resin, and it loses stiffness it has at the room temperature. In that case, it is possible that fluid balancer 122 may be deformed by the load caused by the fluid therein, when fluid balancer 122 rotates both at a high speed and at a low speed. Further, similar problem is caused by swelling pressure of fluid sealed in fluid balancer 122.

Japanese Patent Laying-Open No. 4-332596 proposes a solution of this problem. Here, a fixing boss extending in radial direction only is provided on fluid balancer 122, and a space is provided between the fluid balancer and the outer periphery of the drum for absorbing swell when fluid balancer 122 swells in the radial direction, so that pressure is not applied to the screw portion for fixing. This prevents the screw from becoming loose.

However, the proposal of Japanese Patent Laying-Open No. 4-332596 still has a problem to be solved. As is well known, generally, the fluid balancer is formed of a synthetic resin, and a hollow annular body is formed by joining and thermally welding openings of two annular grooves. These two annular concave grooves have different thicknesses, for example, they may have different rates of expansion. Amount of deformation of concave grooves differ because of the different rates of expansion, and therefore there is a stress at the welded portion, promoting breakage of the fluid balancer. This problem is encountered not only in the drum washer-drier but also in a drum drier.

When the vibration of water tank 3 is to be reduced by using the fluid balancer, there is also the following problem. Fluid balancer 122 does not function until rotation number of drum 171 exceeds the resonance rotation number, because of its operation characteristic. Therefore, in the washer-drier of the type in which drum 171 rotates horizontally, in the initial stage of dehydration, the resonance rotation number is exceeded with the fluid in fluid balancer still biased at a portion in the peripheral direction, generating a formidable vibration at that time. Therefore, it is difficult to simply replace the weight by a fluid balancer.

Japanese Patent Laying-Open No. 4-240481 proposes a solution to this problem. In this proposal, the fluid balancer is divided in radial direction, with mutually different inner circulation resistances. This prevents the fluid sealed in each of the divided portion from being biased at one portion in the peripheral direction, so that the vibration near resonance rotation number is suppressed.

However, in the technique disclosed in Japanese Patent Laying-Open No. 4-240488, for the fluid in the fluid balancer to be lifted against gravity, quite high a circulation resistance is necessary. This degrades balance adjustment function, which is the inherent function of the fluid balancer. The balance adjusting function refers to the function of the internal fluid concentrated on the opposite sides of the biased portion causing imbalance when resonance rotation number is exceeded, for adjusting balance. More specifically, if the inner circulation resistance is too high, the fluid in fluid balancer does not move fast enough when the rotation speed of the drum exceeds the resonance rotation number, taking much time in adjusting balance. As a result, considerable vibration is generated near the resonance rotation member.

SUMMARY OF THE INVENTION

Therefore, an object of the present invention is to suppress the problem caused by vibration at the time of dehydration and drying in a drum washer-drier, and more specifically, to provide a drum-washer drier which can considerably reduce vibration transmitting force to the floor generated by the vibration of the water tank, which can prevent vibration of the floor itself.

Another object of the present invention is to provide a drum washer-drier which can significantly reduce vibration transmitting force to the floor caused by vibration of the water tank and to prevent vibration of the floor itself, by resiliently supporting the water tank stably.

A still further object of the present invention is to provide a drum washer-drier which can significantly reduce vibration transmitting force to the floor caused by the vibration of the water tank and prevent vibration of the floor itself by further reducing vibration of the water tank.

An additional object of the present invention is to provide a drum washer-drier susceptible to reduction in size, which can significantly reduced vibration transmitting force to the floor caused by vibration of the water tank and prevent vibration of the floor itself.

Another object of the present invention is to provide a drum washer-drier which can safely prevent vibration of the drum using a fluid balancer, not influence by the change in temperature.

A still further object of the present invention is to provide a drum washer-drier in which load on the rotation axis can be reduced by using a fluid balancer not influenced by change in temperature, thereby safely preventing vibration of the drum.

A still further object of the present invention is to provide a method of operation of a drum washer-drier by which vibration near resonance rotation number at the time of dehydration can be reduced.

A still further object of the present invention is to provide a method of operating a drum washer-drier which can reduce vibration near resonance rotation number at the time of dehydration and vibration at the transition from low speed rotation to a high speed rotation at a prescribed number of rotation.

A still further object of the present invention is to provide a method of operating a drum washer-drier which can reduce drum vibration near resonance rotation number at the time of dehydration, drum vibration at the transition from low speed rotation to high speed rotation at a prescribed number of rotation, and drum vibration at high speed of rotation during dehydration.

The drum washer-drier in accordance with the present invention includes a washing and drying drum rotating around an approximately horizontal axis, a water tank enclosing the drum, an outer tank resiliently supporting the water tank therein, and a motor for rotating the drum. The water tank has a cylindrical shape with an opening formed at the front. The outer tank includes an outer body having an opening for putting laundry with a door for opening/closing attached thereto, plurality of load receiving portions provided at an upper surface of the external body, and a plurality of suspending rods suspended downward from the plurality of load receiving portions and each having a spring receiving portion at a lower end. The water tank has a plurality of support receiving portions formed respectively below the plurality of load receiving portions and having openings through which tip ends of suspending rods pass. The outer tank further includes a compression spring provided between each of the support receiving portions and a spring receiving portion through which the suspending rod is inserted, and a damper provided between each of the support receiving portion and the lower end of the suspending rod.

At the time of washing, weight of the water tank increases as water and the laundry are put in, and compression spring is compressed. When the weight of the water tank reaches a preset value, the spring is fully compressed, and the length thereof is not compressed further. The water tank comes to be directly supported by the suspending rods through support receiving portions, spring receiving portions and the fully compressed compression springs. Therefore, the amount of lowering of the water tank is limited to a certain value, and hence spring constant of the compression spring can be selected to a small value.

At the time of dehydration, water is drained and the water tank becomes light, so that compression spring returns from the fully compressed state to compressable state. The water tank is resiliently supported by the suspending rods through support receiving portions, spring receiving portions and the compressable compression springs. As already described, even when the spring constant of the compression spring is selected to be small, the amount of lowering of the water tank does not exceed a certain value. Therefore, it is possible to select a small spring constant of the compression spring and suppress vibration transmitted through resilient support to the outer tank and further to the floor.

Conventionally, in order to suppress the amount of vibration transmitted to the floor to be not more than a certain value, assuming that the amount of lowering of the water tank is 30 mm, the load of laundry is 5 kg and the water volume is 30 liter/mm, it is necessary to use a spring having a spring constant of 1.2 Kgf/mm. However, according to the present invention summarized above, it is possible to limit the amount of lowering of the water tank. Therefore, similar or higher effect can be obtained even when a spring having smaller spring constant is used. For example, assuming that other conditions are similar to those of the conventional example and various conditions are set such that the compression spring reaches the fully compressed state when the water volume is 20 liter, the spring constant of the spring used can be set to about 0.7 Kgf/mm.

The vibration transmission force at the time of dehydration is in proportion to the spring constant. Therefore, transmission of considerable vibration of the water tank to the floor can be significantly reduced.

When the support receiving portions are arranged lower than the level of the rotation axis of the drum, the water tank can be supported stably. The support receiving portions may be arranged such that the distance from them to the vertical plane including the center axis of the rotary axis is shorter than those between that vertical plane and the plurality of rod receiving portions. By such arrangement, the rod inclines outward, and hence clearance between the support receiving portions arranged nearer to the lower portion of the rod and the outer tank can be ensured with much room and, on the contrary, the outer tank can be made smaller.

Preferably, each of the plurality of rods has a rod receptacle at an upper end. The outer tank has a plurality of openings through which the rods are inserted, formed at portions corresponding to the rod receiving portions at the portion providing the upper surface of the outer box. Each of the plurality of load receiving portions includes a load receiving member having an opening through which the rod is inserted, arranged at the opening position of the upper surface of the outer tank for supporting from lower side the rod receptacle of the load receptacle of the rod which is inserted through the opening, and a vibration absorber arranged between the rod receiving member and the upper surface of the outer tank, and having an opening through which the rod is inserted.

In this structure, even when the water tank vibrates, only the force in compressing direction acts on the vibration absorber and there is not a force in shearing direction. Therefore, it is not necessary to set the hardness of the vibration absorber higher to withstand the shearing force, and hence vibration can be effectively reduced by using vibration absorber with small spring constant.

According to another aspect of the present invention, the drum washer-drier includes a drying drum formed of metal which is rotatable about a prescribed axis, having front and rear surfaces along the axis and having a circular opening at the front surface, and a motor operatively coupled to the rotary axis. The drum has a ring-shaped groove having an outer sidewall, an inner sidewall and a bottom surface, formed at least on the front surface or the rear surface. The drum washer-drier further includes a ring-shaped fluid balancer inserted in the groove such that its outer side surface is supported by the outer and inner walls.

During drying, it is possible that the fluid balancer formed of synthetic resin is heated to a higher temperature for drying and may possibly be deformed. However, in the present structure, the outer side surface of the fluid balancer is reinforced by the sidewalls of the groove formed in the metal drum, and hence deformation of the fluid balancer is prevented.

The outer sidewall of the drum groove may be provided with a plurality of rectangular holes. The fluid balancer may have a plurality of convex portions to be fitted in the rectangular holes, formed at positions corresponding to the rectangular holes on the outer side surface thereof. By fitting the convex portions in the rectangular holes, the fluid balancer can be fixed on the drum in a simple manner.

A plurality of ribs may be formed on the front surface which faces outward when the fluid balancer is fitted in the groove. When the drum is rotated during drying, these ribs provide a fan, and wind generated by the fan cools the drum and the fluid balancer, thus preventing deformation of the fluid balancer.

The body of the fluid balancer may have such a size that can be inserted in the groove with a space from the drum, a plurality of projections may be formed on the outer side surface, the inner side surface and the bottom surface of the fluid balancer, and the fluid balancer may be fixed in the groove of the drum with a space formed between the drum and the fluid balancer. The drum and the fluid balancer contact only at the projections, and there is space between these at other portions. Therefore, heat transmitted from the metal drum to the fluid balancer formed of synthetic resin can be reduced.

According to another aspect of the present invention, the method of operating the drum washer-drier includes, after washing or rinsing, the step of low speed rotation in which the motor is controlled such that the drum is rotated for a prescribed time period at a rotation speed higher than critical rotation speed of the fluid balancer and lower than the resonance rotation speed caused by resilient support, and after the drum is rotated for a prescribed time period at the prescribed rotation speed, the step of high speed rotation in which the motor is controlled such that the drum is rotated at a predetermined high rotation speed for dehydration.

At the time of dehydration, water in the tank is drained, and the drum is rotated at a low speed, for example at 55 rpm in order to untangle laundry in the drum. At this time, the fluid in the fluid balancer is biased to the lower side because of gravity. Thereafter, drum is rotated at a prescribed rotation speed which is higher than the critical rotation speed, for example, about 65 rpm but lower than the resonance rotation speed, that is, 250 rpm. Namely, the drum is rotated at about 160 rpm, for example. At this time, the fluid in the fluid balancer is not biased but distributed as a ring in the circumferential direction, because of centrifugal force. Therefore, large vibration near the resonance rotation speed is not generated and the resonance rotation speed can be passed smoothly.

As for the prescribed rotation speed for this purpose, a plurality of different rotation speeds may be selected, and lower to higher ones of the selected rotation speeds may be selected so that the rotation speed of the fluid balancer is gradually increased. Then distribution of the fluid in the fluid balancer changes gradually and the fluid balancer functions gradually. Therefore, even in the step of increasing the rotation speed of the drum, vibration of the drum can be suppressed.

A vibration sensor may be provided in the water tank of the drum washer-drier, whether the detected value of the vibration sensor is higher than a prescribed value or not may be determined before the start of the high speed rotation step, and in accordance with the result of determination, whether to start the high speed rotation step or to return to the low speed rotation step may be determined. Only when the vibration of drum at a prescribed rotation speed is lower than a prescribed value before transition to the high speed rotation, high speed rotation starts. Therefore, drum vibration at high speed rotation can also be suppressed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
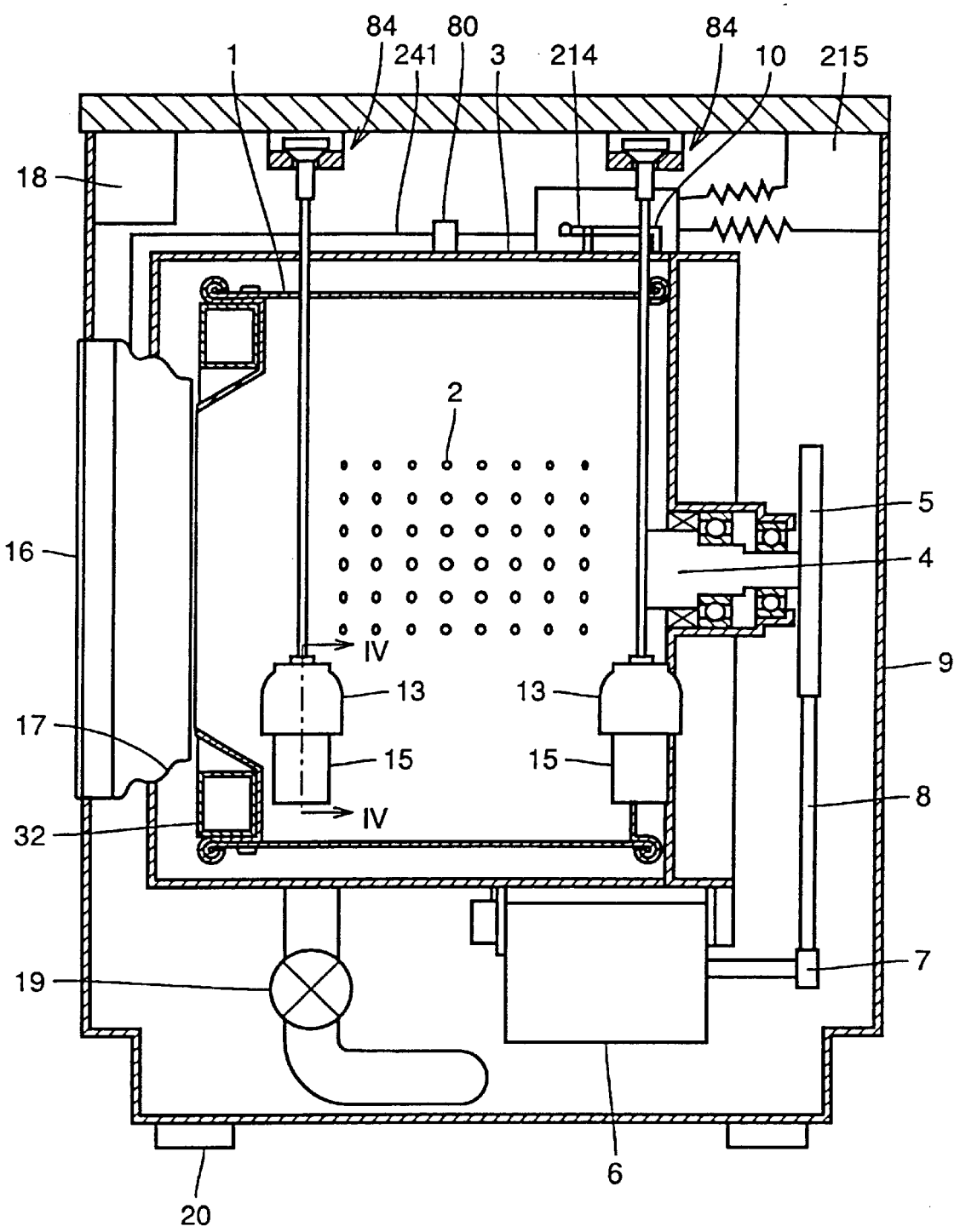
FIG. 1 is a cross section of a drum washer-drier in accordance with a first embodiment.
Figure 2:
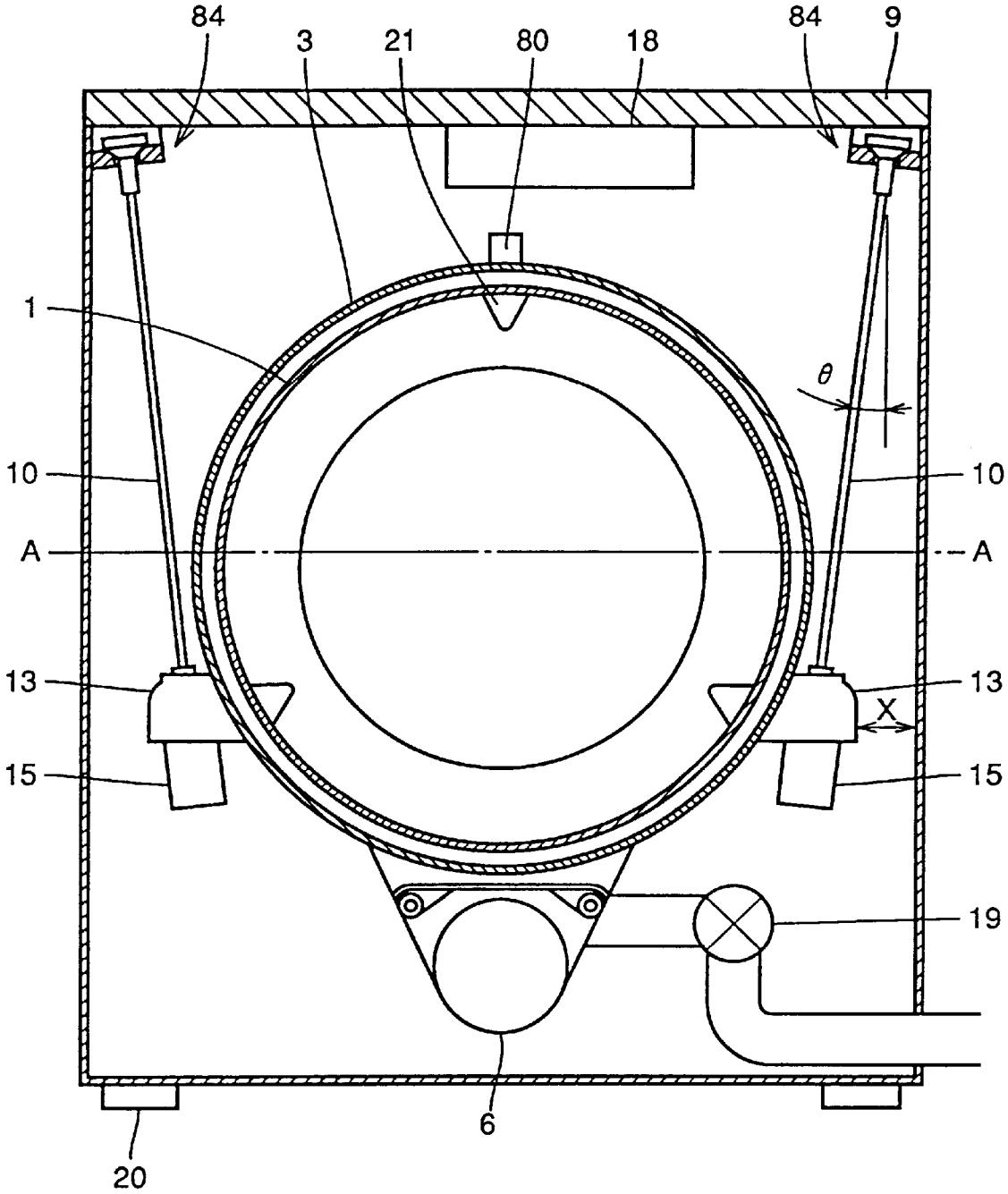
FIG. 2 is a cross section along the front surface of the drum washer-drier of the first embodiment.

By embodiment of the drum washer-drier in accordance with the present invention and method of operation therefor will be described with reference to FIGS. 1 to 10. The drum washer-drier is also one form of a drum drier. Referring to FIGS. 1 and 2, the washer includes a drum 1 having a number of small holes 2 containing and rotating laundry, and a water tank 3 for holding water and enclosing drum 1. Water tank 3 has a hollow cylindrical shape and at the central portion on a rear surface thereof, an approximately horizontal rotary axis 4 is rotatably supported with one end fixed at the center of the bottom surface of drum 1. At the other end of rotary axis 4, a drum pulley 5 is fixed. On the lower surface of water tank 3, a driving motor 6 is attached. A motor pulley 7 is attached to the tip end of rotary axis of driving motor 6, and motor pulley 7 and drum pulley 5 are operatively coupled by means of a belt 8.

Figure 4:
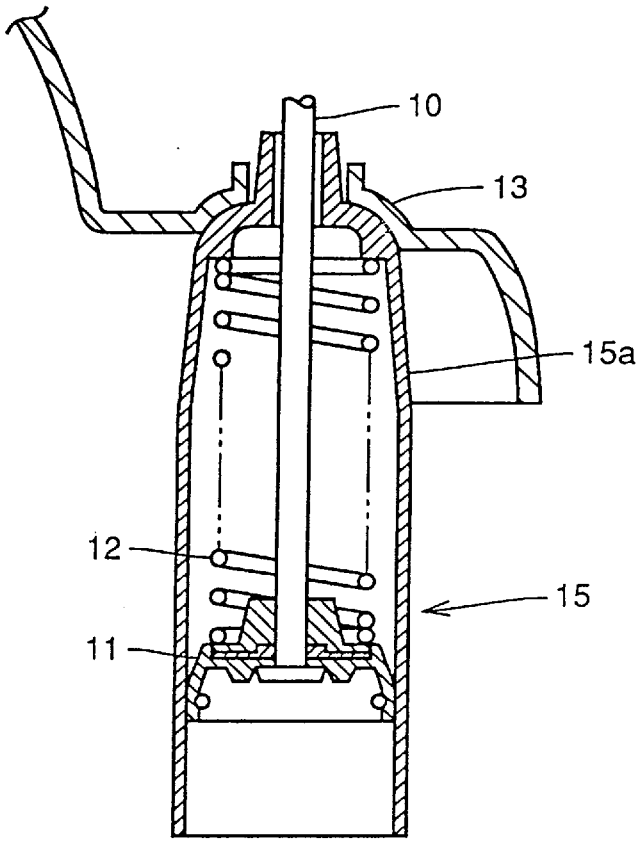
FIG. 4 is an enlarged cross section of support receiving portion and dumper portion of the drum washer-drier in accordance with the first embodiment.

Drum 1, water tank 3 and motor 6 constitute a vibrating body. The vibrating body is resiliently supported on a box of an outer tank 9 in the following manner. On an inner upper surface of the box of outer tank 9, a plurality of rod receiving portions 84 are provided. A plurality of suspending rods 10 are suspended from the plurality of rod receiving portions 84, respectively. The structure of rod receiving portion 84 will be described later with reference to FIG. 5. Meanwhile, the water tank 3 has support receiving portions 13 at positions lower than the central axis at front and rear portions on opposing sides, through which lower ends of suspending rods 10 pass. Referring to FIG. 4, at the lower end of suspending rod 10 passing through and projecting downward from the support receiving portion 13, a spring receiving portion 11 is fixed. To the suspending rod 10 between support receiving portion 13 and spring receiving portion 11, a compression spring 12 is inserted. As the support receiving portion 13 is supported by spring receiving portion 11 with compression spring 12 inserted therebetween, water tank 3 is suspended and resiliently supported in outer tank 9.

At the lower end portion of suspending rod 10, there is provided a damper 15 which generates friction resistance as the compression spring 12 is expanded/compressed. Referring to FIG. 4, damper 15 includes a damper sleeve 15*a* which has a shape that encloses spring receiving portion 11 and compression spring 12 and inserted to the lower end portion of suspending rod 10. Outer peripheral edge of spring receiving portion 11 is slidably in contact with the inner surface of damper sleeve 15*a*. Consequently, as the compression spring 12 is expanded/compressed, friction resistance is generated between the inner surface of dumper sleeve 15*a* and the outer peripheral edge of spring receiving portion 11.

Again referring to FIG. 1, at the front surface of the box of outer tank 9, there is provided a door 16 for putting in the laundry. Between the water tank 3 and outer tank 9 at this portion, a bellows shaped door packing 17 is provided. When door 16 is closed, water tank 3 becomes water tight, because of the door packing 117. At an upper portion in the box of outer tank 9, a control circuit 18 for controlling operation in various steps is provided. Below the water tank 3, there is a drain valve 19 for draining water and the like from water tank 3, and water is drained at the time of dehydration by this valve. There are legs 20 at the bottom surface of the box of outer tank 9, and the washer as a whole is supported on the floor.

Referring to FIG. 2, a plurality of baffles 21 are provided on the inner peripheral surface of drum 1. At an upper portion of water tank 3, there is provided a vibration sensor 80 for detecting vibration of water tank 3. Structure of vibration sensor 80 will be described later.

As shown in FIG. 2, the space between support receiving portions 13 when viewed from the front is shorter than the distance between rod receiving portions 84, and hence suspending rods 10 are inclined by an angle θ with respect to the vertical direction. Because of this inclination, a clearance X between the support receiving portion 13 and the box of the outer tank 9 can be selected smaller than when the suspending rods 10 are vertical. Accordingly, the size of the washer as a whole can be reduced.

As shown in FIG. 1, there are a drying air duct 241 for guiding drying air to water tank 3, a drying heater 214 arranged in drying air duct 241, and a heat exchanger 215 for removing moisture arranged in drying air duct 241. In FIG. 2, these elements are omitted for simplicity.

Figure 3:
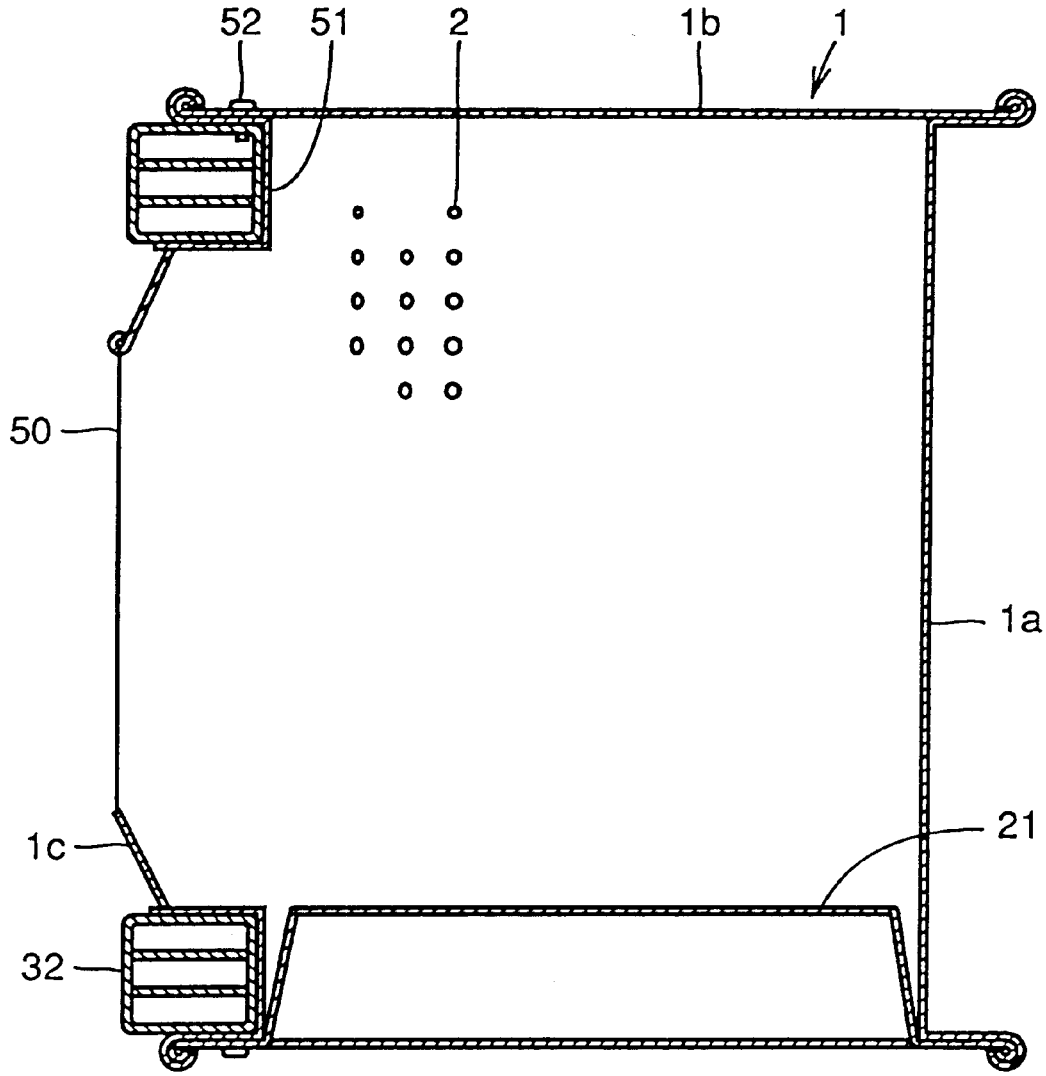
FIG. 3 is a cross section of the drum of the drum washer-drier in accordance with the first embodiment.

Referring to FIG. 3, drum 1 includes components such as metal drum bottom 1*a,* a drum body 1*b* and a drum lid 1*c*, and it is formed by joining these components. Drum lid 1*c* has a circular opening 50 formed at the center, and an annular groove 51 therearound. In this groove 51, a fluid balancer 32 is fitted such that at least its inner and outer peripheries are in tight contact with the side surface of groove 51. Fluid balancer 32 is fixed on drum 1 by means of screw 52 from the outer peripheral side. Fluid balancer 32 is a hollow annular body formed of synthetic resin, with fluid sealed therein. A plurality of small holes 2 are formed on the peripheral side surface of drum body 1*b*. Further, baffles 21 are provided as mentioned above, on inner side surface of drum body 1*b* (FIG. 2).

Referring to FIGS. 1 and 2, the height position of support receiving portion 13 provided at water tank 3 can be arbitrarily set. However, in the washer in accordance with this embodiment, the support receiving portions 13 are provided at the central position A of rotary axis 4 or lower than that. The position of center of gravity of the vibrating body constituted by water tank 3, drum 1 and driving motor 6 would be lower than the level A of the center of rotary axis 4 in this structure. Therefore, when the level of the support receiving portion 13 is selected in this manner, water tank 3 can be more stably suspended and resiliently supported. Vibration transmitted in each of the steps of washing, rinsing and dehydration can be suppressed and, in addition, vibration of water tank 3 itself can be suppressed.

Figure 5:
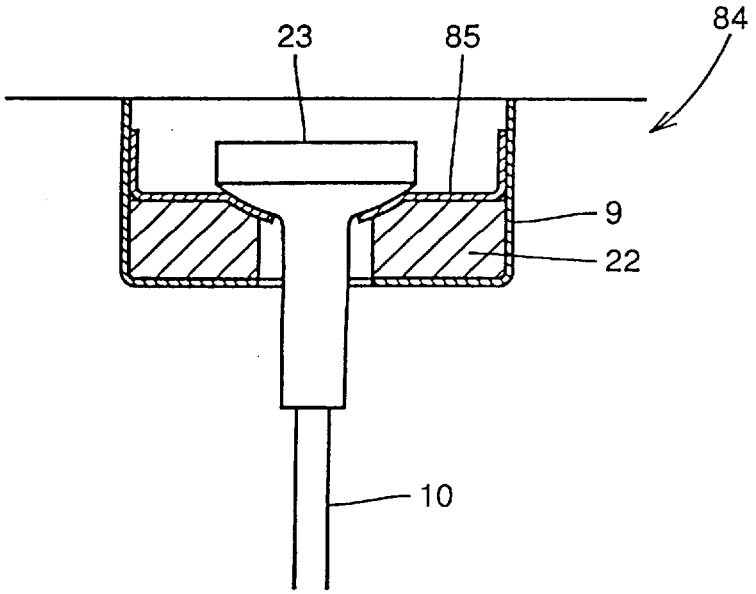
FIG. 5 is an enlarged cross section of a load receiving portion of the drum washer-drier in accordance with the first embodiment.

Referring to FIG. 5, structure of the rod receiving portion 84 will be described in greater detail. At the portion of rod receiving portion 84, on the lower side at an upper portion of the body of outer tank 9, there is formed a hollow portion projecting downward, and the rod receiving portion 85 is arranged therein. Between rod receiving portion 85 and outer tank 9, there is a vibration absorber 22 formed of low rebound rubber mold. Rod receiving member 85 and vibration absorber 22 have openings, and outer tank 9 also has an opening at the corresponding portion. A hemispherical rod receptacle 23 fixed on an upper end of suspending rod 10 is inserted through and supported by the rod receiving member and vibration absorber 22 and received.

As vibration absorber 22 is interposed between rod receiving member 85 and outer tank 9, vibration of water tank in various steps of washing can be reduced. At this time, as is apparent from FIG. 5, vibration absorber 22 receives only the compression load supporting water tank 3 through rod receptacle 23 and load receiving member 85. There is not a shearing force acting on vibration absorber 22. Therefore, it is possible to select low rubber hardness for vibration absorber 22. For example, even if it is necessary to use a material having rubber hardness of 90° C. when shearing force acts on vibration absorber 22, in the present embodiment a material having rubber hardness of about 40° C. may be used without any problem. Since a material having low rubber hardness can be used for vibration absorber 22, vibration transmitted from water tank 3 to outer tank 9 can be significantly reduced.

Figure 6:
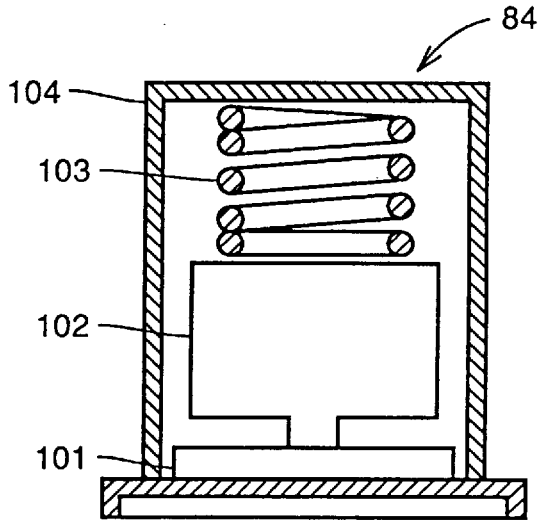
FIG. 6 is a cross section of a vibration sensor of the drum washer-drier in accordance with the first embodiment.

Referring to FIG. 6, vibration sensor 80 includes a case 104, a piezoelectric device 101 arranged in case 104, a weight 102 and a spring 103. Weight 102 vibrates in case 104 in accordance with vibration of water tank 3, and at this time, weight 102 is biased in the direction to piezoelectric device 101 by means of spring 103, and hence piezoelectric device 101 generates an electric signal of which magnitude depends on vibration of water tank 3.

Figure 7:
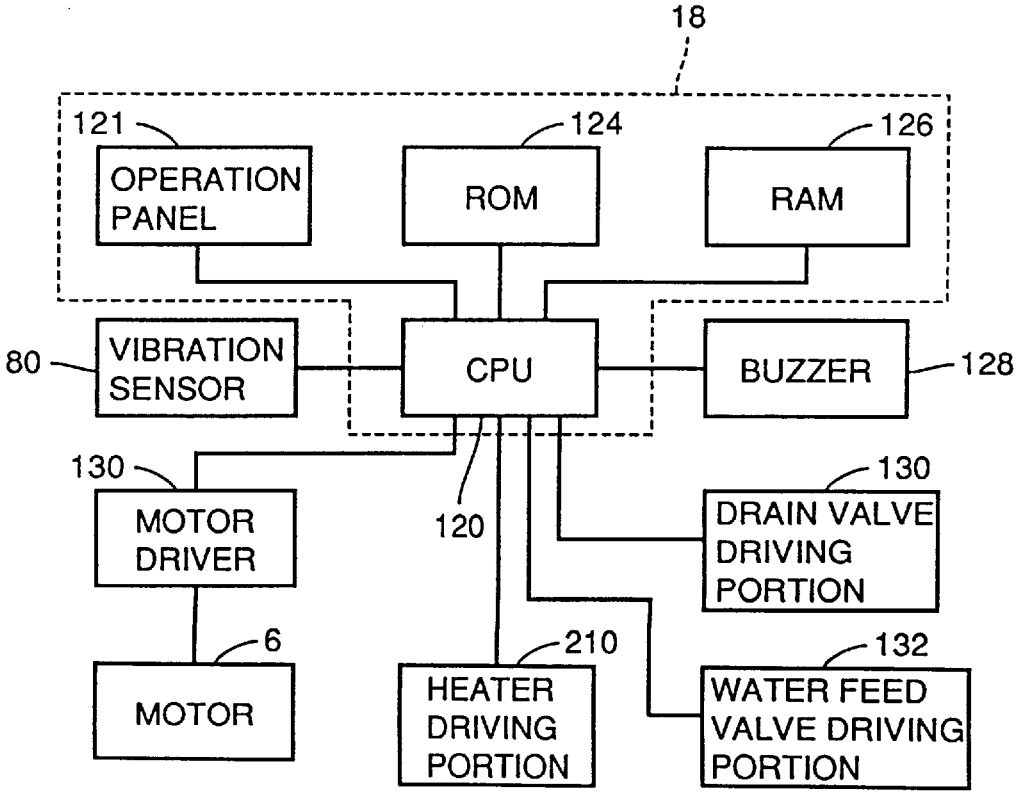
FIG. 7 is a schematic block diagram of a control circuit for the drum washer-drier in accordance with the first embodiment.

Referring to FIG. 7, control circuit 18 includes a motor driver 130 for driving motor 6, vibration sensor 80, a heater driving portion 210 for driving a heater 24, a drain valve driving portion 130 for driving drain valve 19, a water feed valve driving portion 13 for driving a water feed valve, not shown, a CPU 120 connected to a buzzer 128, an operation panel 122 connected to CPU 120, an ROM (Read Only Memory) 124 storing a program for controlling various steps of washing executed by CPU 120, and an RAM (Random Access Memory) used as working area by CPU 120. Control circuit 18 operates in the similar manner as a common control computer and method of operation itself is known. Therefore, details thereof is not repeated. Control particular to the present embodiment will be described later with reference to FIG. 8.

Figure 9:
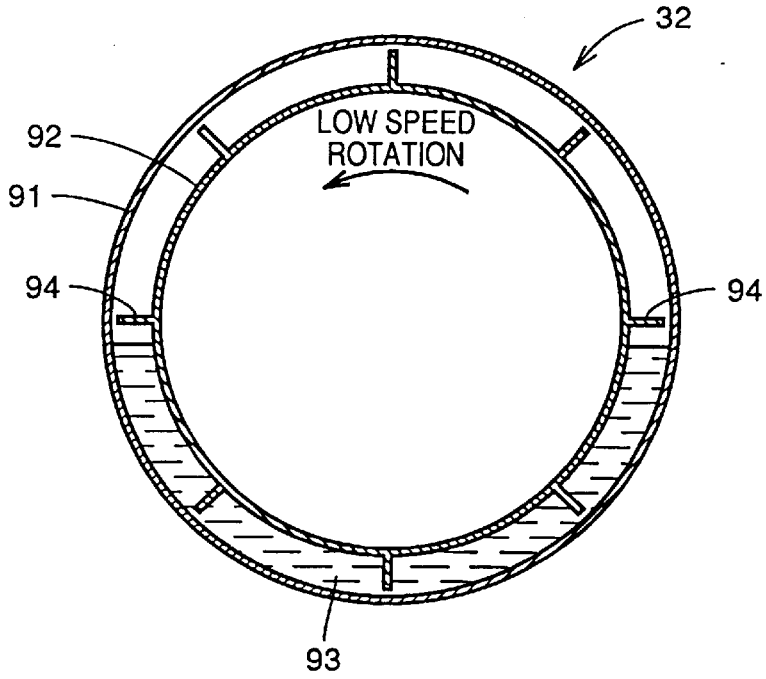
FIG. 9 is a cross section taken along the front surface of a fluid balancer.

Referring to FIG. 9, fluid balancer 32 is formed of an annular synthetic resin, and includes an outer periphery 91, an inner periphery 92, a section member 94 formed radially from inner periphery 92, and a fluid 93 such as salt solution sealed in a space between inner wall 92 and outer wall 91.

The drum washer-drier in accordance with the first embodiment operates in the following manner. Referring to FIGS. 1 and 2, door 16 is opened and laundry is put in the drum 1. Thereafter, through water feed valve (not shown), water is fed to water tank 3. Filling of water is continued until water reaches a prescribed level. At this time, weight of water tank 3 increases as the water is fed, and compression spring 12 (see FIG. 4) is gradually compressed. When a prescribed amount of compression, that is, prescribed amount of lowering of water tank 3 (for example, 20 mm) is reached, compression spring 12 reaches the fully compressed state, and thereafter water tank 3 is directly supported by suspending rods 10, so that it does not further lower. When the water reaches a prescribed level, water feeding terminates. Thereafter, washing by tumbling is performed by rotating drum 1 at a low speed. Then water is drained from water tank 3 by opening drain valve 19, water is fed again and rinsing is performed in the same manner as washing, by tumbling.

Figure 8:
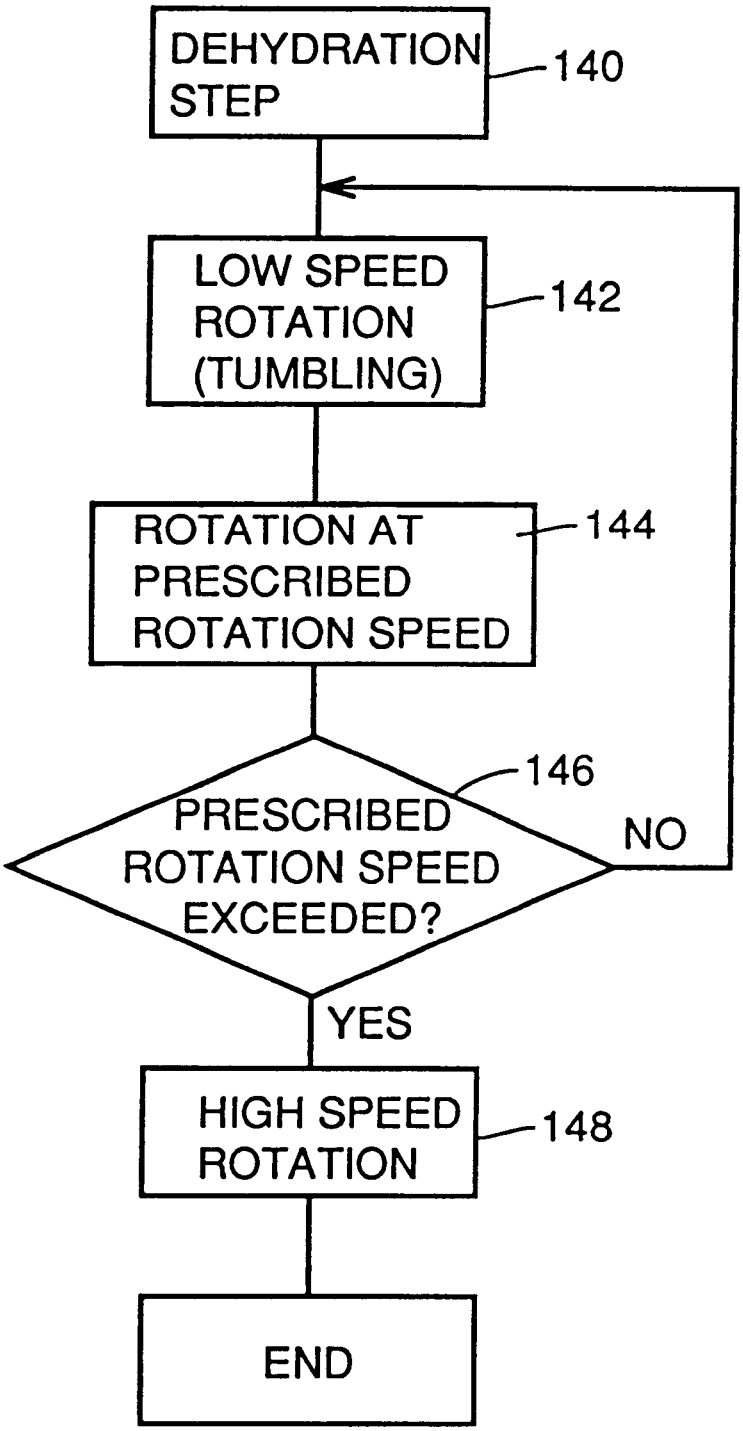
FIG. 8 is a flow chart showing control at the time of dehydration of the drum washer-drier in accordance with the first embodiment.
Figure 10:
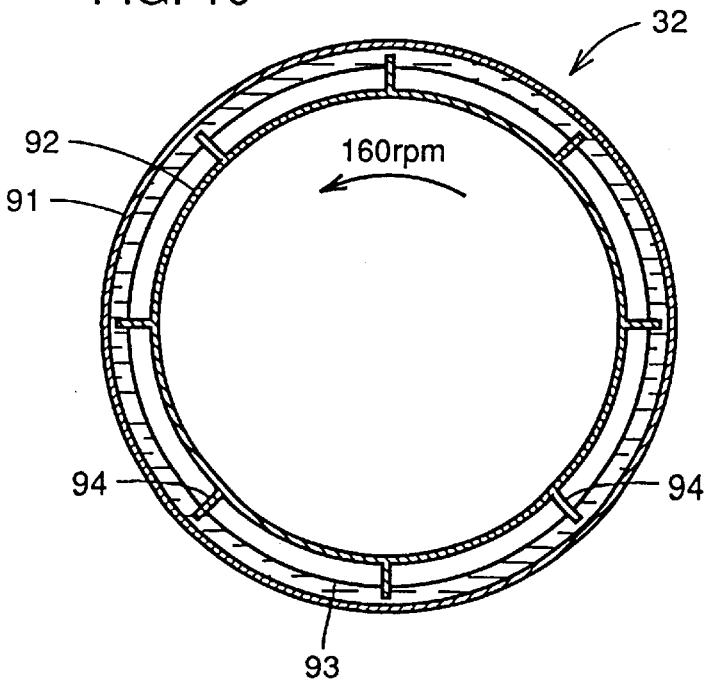
FIG. 10 is a cross section taken along the front surface of the fluid balancer.

Dehydration is performed by draining water from water tank 3 by opening drain valve 19, rotating drum 1 at a high speed so that water is removed by centrifugal force from the laundry, and the water is further removed out from the drum 1 through small holes 2. In the present embodiment, rotation control of drum I is performed by control circuit 18 in the following manner. Referring to FIG. 8, when dehydration step 140 starts, water in water tank 3 is drained, drum 1 is rotated at a low speed (for example 55 rpm) to entangle clothes in drum 1, and tumbling is performed (142). Then, as shown in step 142, high speed rotation for dehydration is started. However, in the present embodiment, the operation is not immediately switched to the high speed rotation. More specifically, first, drum 1 is rotated at a prescribed of rotation speed (for example 160 rpm) which is higher than a critical rotation speed but lower than the resonance rotation speed for a prescribed time period (for example, 15 sec.) (144). Therefore, though fluid 93 in fluid balancer 32 is concentrated in the gravity direction as shown in FIG. 9 while the drum is rotating at low speed in step 142, fluid 93 is distributed as a ring along the periphery of fluid balancer 32 as shown in FIG. 10 during prescribed rotation in step 144. Therefore, resonance rotation speed can be smoothly exceeded, and after the resonance rotation speed is exceeded, the fluid moves in the fluid balancer and adjusts balance, whereby vibration of water tank 3 can be suppressed.

Thereafter, whether the value of vibration input through vibration sensor 80 is smaller than a prescribed value or not is determined (146). If the detected-value is not higher than a prescribed value, drum 1 is rotated at high speed (for example, at 100 rpm), so that water contained in the laundry is removed through small holes 2 and dehydrated (148). If the value of vibration detected in step 146 is higher than the prescribed value, the flow returns to step 142, and rotation of drum 1 at a low and a prescribed rotation speed is repeated. In this manner, high speed rotation is performed only when vibration of water tank 3 at the prescribed rotation speed in step 144 is smaller than a prescribed level. Therefore, maximum bias of the laundry can be limited. Therefore, not only vibration of water tank near resonance rotation speed but also vibration of water tank 3 at high speed rotation can be suppressed.

Feature of the drum washer-drier in accordance with the present embodiment at the time of dehydration will further be described. At the time of dehydration, water tank 3 vibrates to some extent because of the bias in laundry. However, in the present embodiment, water tank 3 is suspended and resiliently supported by suspending rod 10 and compression spring 12. Further, spring constant of compression spring 12 is set small. Therefore, transmission force of vibration is much smaller as compared with the prior art. Further, since dumper 15 exhibiting dumper function is provided at the lower end of suspending rod 10, vibration transmitted to the floor through dumper 15 is not direct but indirect, through a path including dumper 15, suspending rod 10 and outer tank 9. The transmission of vibration becomes small as it is alleviated by vibration absorber 22 and outer tank 9. General vibration transmission to the floor is made smaller than the prior art examples, and therefore vibration of the floor can be prevented.

In the step of drying, drying air is heated and circulated by drying heater 214 arranged in drying air duct 241, so that moisture in the laundry is evaporated. The evaporated water is removed by heat exchanger 215. At this time, drum 1 is rotated at a low speed so that the laundry is uniformly heated, and drying is facilitated.

In the above described operation, in the step of drying, hot air circulates in water tank 3. Therefore, drum 1 and fluid balancer 32 arranged in water tank 3 are also heated. As fluid balancer 32 is formed of synthetic resin, it is softened by heat and its stiffness lowers. However, as the inner and outer peripheries of fluid balancer 32 are tightly fit in a groove 51 formed on metal drum 1, fluid balancer 32 is, as a result, reinforced by the inner wall of groove 51 on drum 1, and as a secondly result, it comes to have rigidity. Therefore, deformation of fluid balancer 32 caused by inner or outer force in the radial direction acting on fluid balancer 32 can be prevented.

Here, the force acting on fluid balancer 32 refers to the load applied by the fluid sealed in fluid balancer 32 rotating about the horizontal axis exceeding a prescribed number of rotation to the inner surface of fluid balancer 32 in radial outer direction as the fluid is diffused in fluid balancer 32 by centrifugal force, or the load applied by the fluid in the gravity direction as it is concentrated at a lower portion of fluid balancer 32 when fluid balancer 32 rotates at a low speed or when it is stopped.

As described above, in the drum washer-drier in accordance with the first embodiment, water tank 3 is suspended and resiliently supported by suspending rods suspended from an upper portion in the box of outer tank 9. Further, a compression spring having small spring constant is interposed between the support receiving portion and the spring receiving portion. Therefore, at the time of washing, water tank 3 is fixedly held at a prescribed height, and during dehydration, it is resiliently supported by the compression spring. Since spring constant of compression spring can be set at a small value, its force of transmitting vibration of water tank 3 to the outside during dehydration is very small. Further, since water tank 3 is suspended and held by suspending rods 10, vibration absorber 22 provided at the rod receiving portion receives only the compression load. Since vibration absorber 22 does not receive any shearing force, a material having small spring constant may be used for vibration absorber 22. Therefore, the amount of vibration transmitted outward can further be reduced.

Further, prior to high speed rotation for dehydration, drum 1 is rotated at a prescribed rotation speed which is higher than the critical rotation speed but lower than the resonance rotation speed for a prescribed time period. Therefore, resonance rotation speed can be exceeded smooth, and vibration near resonance rotation speed can be suppressed. Further, vibration sensor is provided and operation is switched to the high speed operation only when the vibration of water tank 3 at the prescribed rotation speed is not higher than a prescribed value. Therefore, vibration at high speed of rotation can also be suppressed.

Further, drum 3 is formed of metal, and the fluid balancer formed of synthetic resin is fit in a groove formed on drum 3, with the outer peripheral portion of the balancer supported by the wall surface of the drum groove. Consequently, even when the fluid balancer is heated to a high temperature during drying, for example, and a synthetic resin forming the fluid balancer comes to have lower stiffness, deformation of the fluid balancer can be prevented as the fluid balancer is supported in the radial direction by the inner wall of drum groove.

In the above described first embodiment, suspension resilient support of water tank 3, improvement at transition to high speed rotation for dehydration, and improvement of drum and fluid balancer structures are combined, and a drum washer-drier in a most preferable form is implemented. However, the effect of reduced vibration as compared with the prior art example can be attained even when any one of the above features is employed.

Second Embodiment

Figure 11:
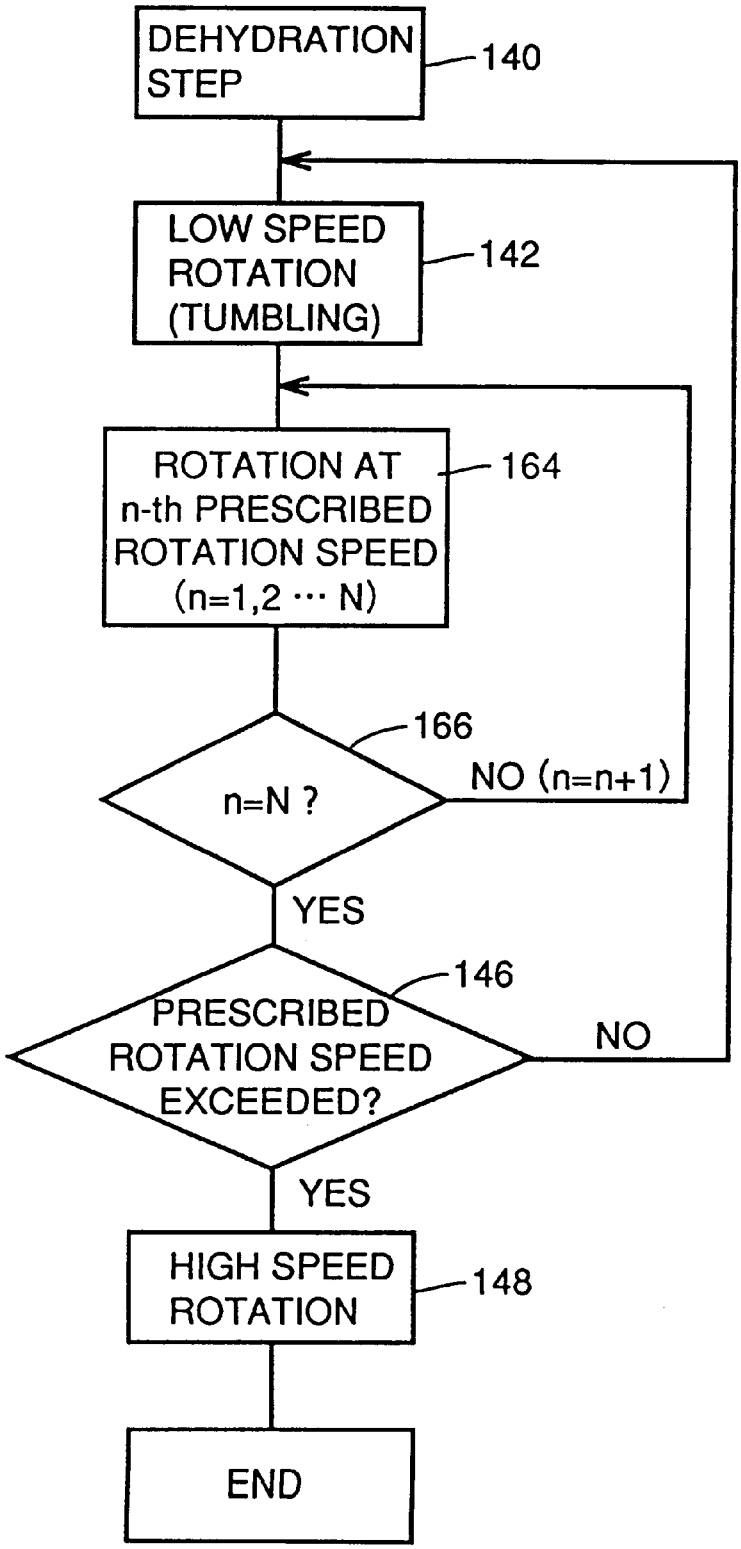
FIG. 11 is a flow chart showing control flow of the drum washer-drier in accordance with a second embodiment.

FIG. 11 shows flow of control in the step of dehydration in accordance with the second embodiment of the present invention. The structure of the hardware of drum washer-drier itself may be or may not be the same as the first embodiment.

Of the flow chart shown in FIG. 11, steps similar to those of the flow chart shown in FIG. 8 of the first embodiment are denoted by the same reference characters. Therefore, detailed description thereof is not repeated here. The flow chart of FIG. 11 differs from that of FIG. 8 in that step 144 of FIG. 8 is replaced by steps 164 and 166 in FIG. 11. More specifically, in the drum washer-drier in accordance with the second embodiment, different from the first embodiment in which only one rotation speed is selected as the prescribed rotation speed for the process of step 144, a plurality of different rotation speeds are selected as prescribed rotation speeds, and rotation of the drum is performed successively selecting the rotation speed starting from the lowest rotation speed to higher rotation speed. Examples of the plurality of prescribed rotation speeds may include 100, 130, and 160 rpm.

Referring to FIG. 11, in step 164, the prescribed rotation speed is set to the n-th prescribed rotation speed. Here, it is assumed that the initial value of n is 1 and the maximum value of n is N. When n is 1, the rotation speed is the lowest, and as the number n increases, the rotation speed becomes higher, and highest rotation speed is reached when n=N. However, any rotation speed from n=1 to N is selected to be higher than the critical rotation speed but lower than the resonance rotation speed caused by resilient support.

In step 164, after drum 1 is rotated for a prescribed time period at n-th prescribed rotation speed, it is determined whether n equals to the maximum value N. If n is not equal to the maximum value N, 1 is added to n and the process of step 164 is repeated. If n equals to maximum value N, the flow proceeds to step 146, and similar processes as in the first embodiment follows.

In this manner, as the drum 1 is operated with the rotation speed increased gradually from lower to higher rotation speeds, fluid in fluid balancer 32 is distributed smoothly to a ring shape. Therefore, by the time prescribed rotation speed with n=N is reached, fluid balancer 32 is ready to fully exhibit its function, and even at a rotation speed lower than the resonance rotation speed, vibration of water tank 3 can be suppressed. In the second embodiment also, by providing vibration sensor, high speed rotation may be started only when vibration of water tank 3 at a prescribed rotation speed (n=N) is smaller than a predetermined prescribed value. By such operation, vibration of water tank 3 can be suppressed not only at the resonance rotation speed but also at a high speed rotation, as in the first embodiment.

Third Embodiment

Figure 12:
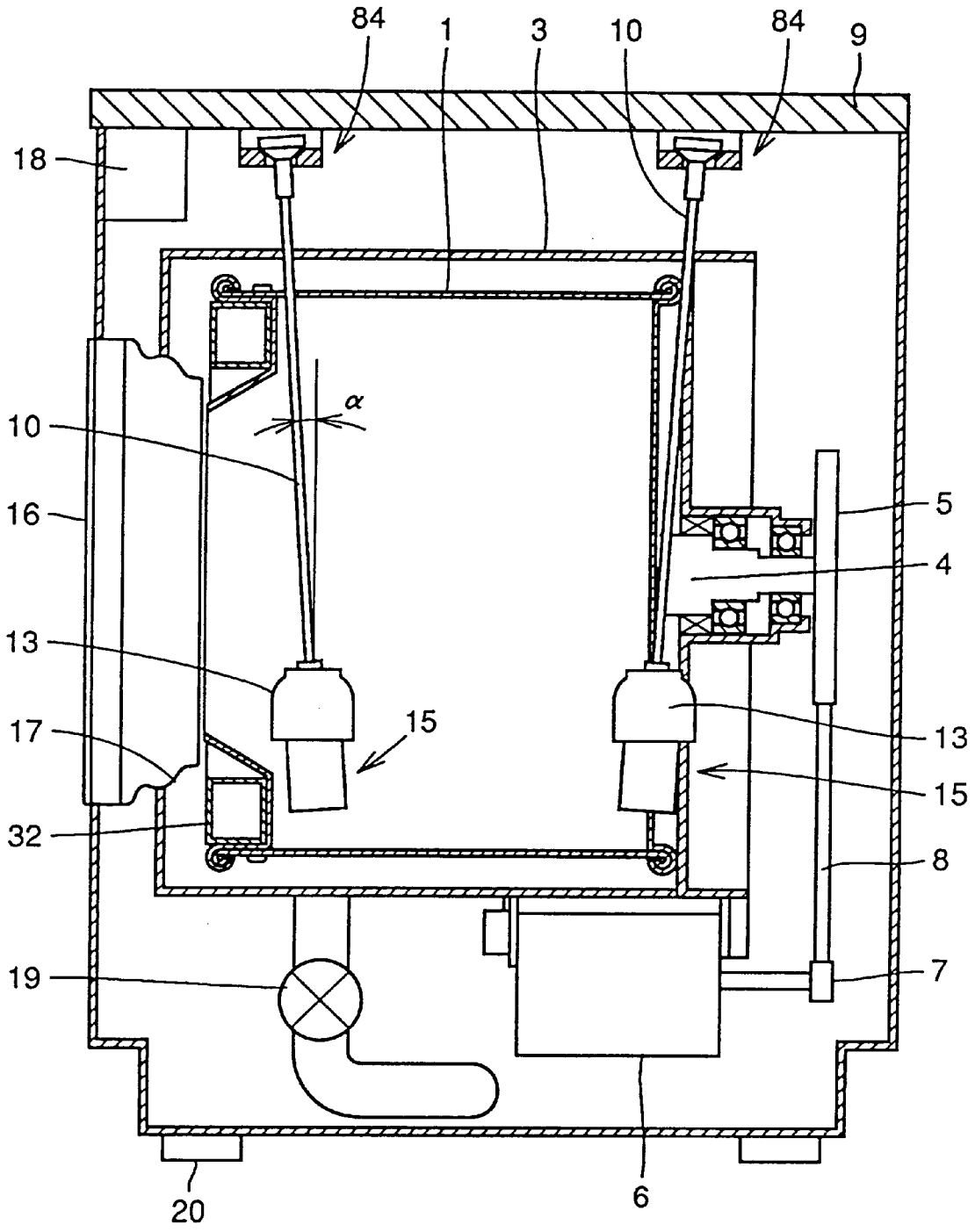
FIG. 12 is a cross section of a drum washer-drier in accordance with a third embodiment.

The drum washer-drier in accordance with the third embodiment of the present invention will be described with reference to FIG. 12. The front view of the drum washer-drier is the same as that of FIG. 2 of the first embodiment. In FIG. 12, various components for drying and vibration sensor 80 are omitted for simplicity.

The drum washer-drier in accordance with the third embodiment is characterized in that in suspending the rods 10, in addition to the prescribed angle of incarnation θ in left and right directions of suspending rod 10, there is a prescribed angle of rotation α in the front end rear directions of suspending rod 10 for attachment, as shown in FIG. 5. Namely, suspending rods 10 are attached inclined both in the left and right and front end rear directions of the washing machine. Therefore, the space in the front and rear directions of the support receiving portion 13 is selected to be smaller than the distance in front end rear directions of support receiving portions 84. Except this point, the structure of the washing machine in accordance with the third embodiment is the same as that of the first embodiment. Therefore, details thereof is not repeated.

In the washing machine in accordance with the third embodiment, the water tank is resiliently supported by suspending rod 10 and compression spring 12 in every direction, that is, left, right, front end rear. Therefore, vibration of the water tank 3 is reduced that much. At this time, it is not necessary to set spring constant of compression spring 12 at a high value. Therefore, there is not a possibility that much vibration is transmitted.

Fourth Embodiment

Figure 13:
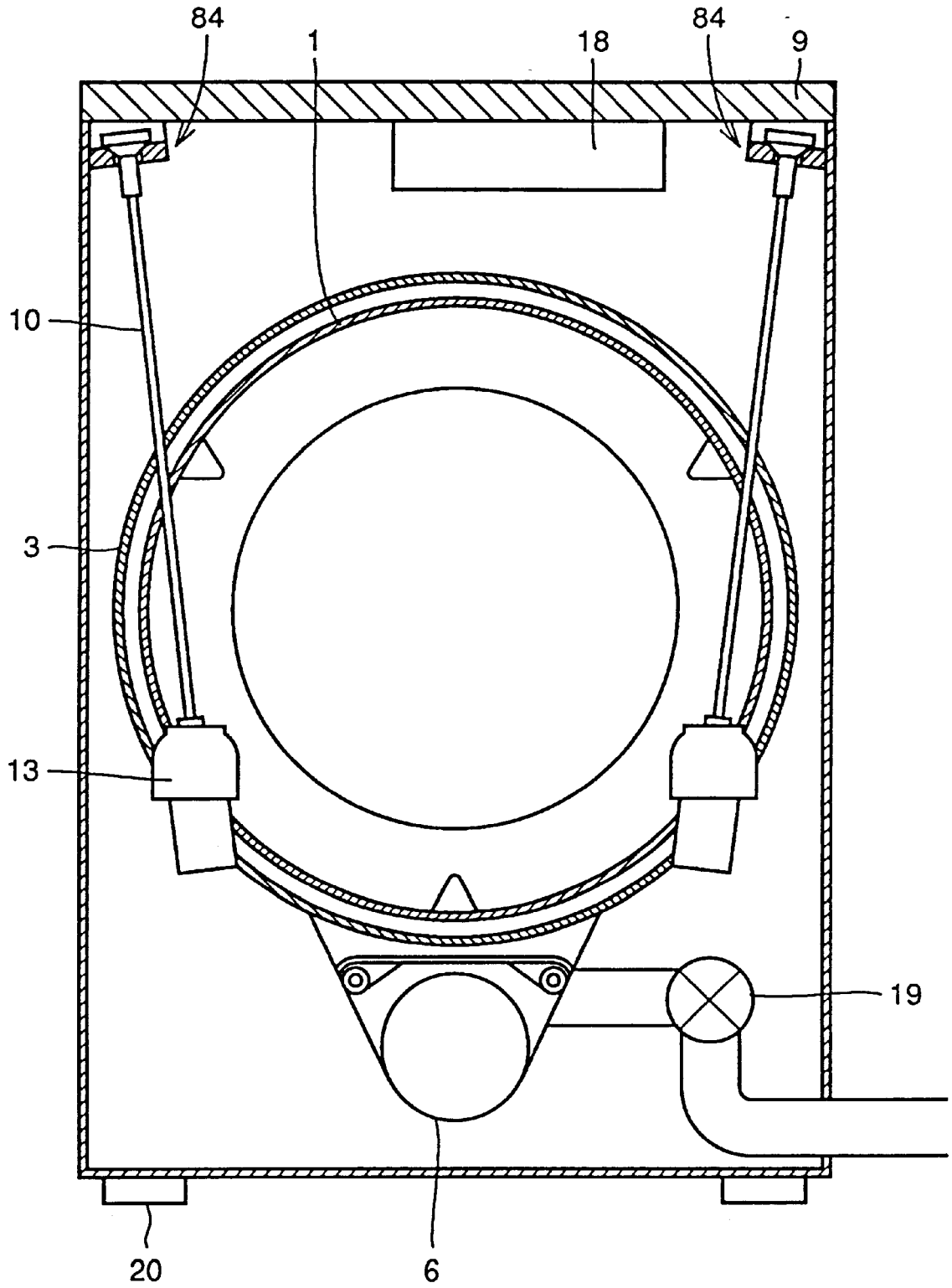
FIG. 13 is a cross section taken along the front surface of a drum washer-drier in accordance with a fourth embodiment.

FIG. 13 is a front view of a drum washer-drier in accordance with a fourth embodiment of the present invention. In the washing machine in accordance with the fourth embodiment, support receiving portions 13 are attached at two portions on each of the left and right sides of the front side and rear side (not shown) of the water tank. Except this point, the washing machine of FIG. 13 is similar to the washing machine of the first embodiment. Therefore, detailed description is not repeated. In FIG. 13, some of the components are not shown for simplicity.

In the drum washer-drier in accordance with the fourth embodiment, as is apparent from the comparison between FIGS. 13 and 2, the dimension of the box of outer tank 9 in the left and right directions can be made smaller. Meanwhile, the effect of reducing vibration is not affected at this time. Therefore, in accordance with the washing machine of the fourth embodiment, the washing machine as a whole can be made compact while maintaining the effect of reduced vibration. This facilitates installation of the washing machine in a system kitchen, for example.

Fifth Embodiment

Figure 14:
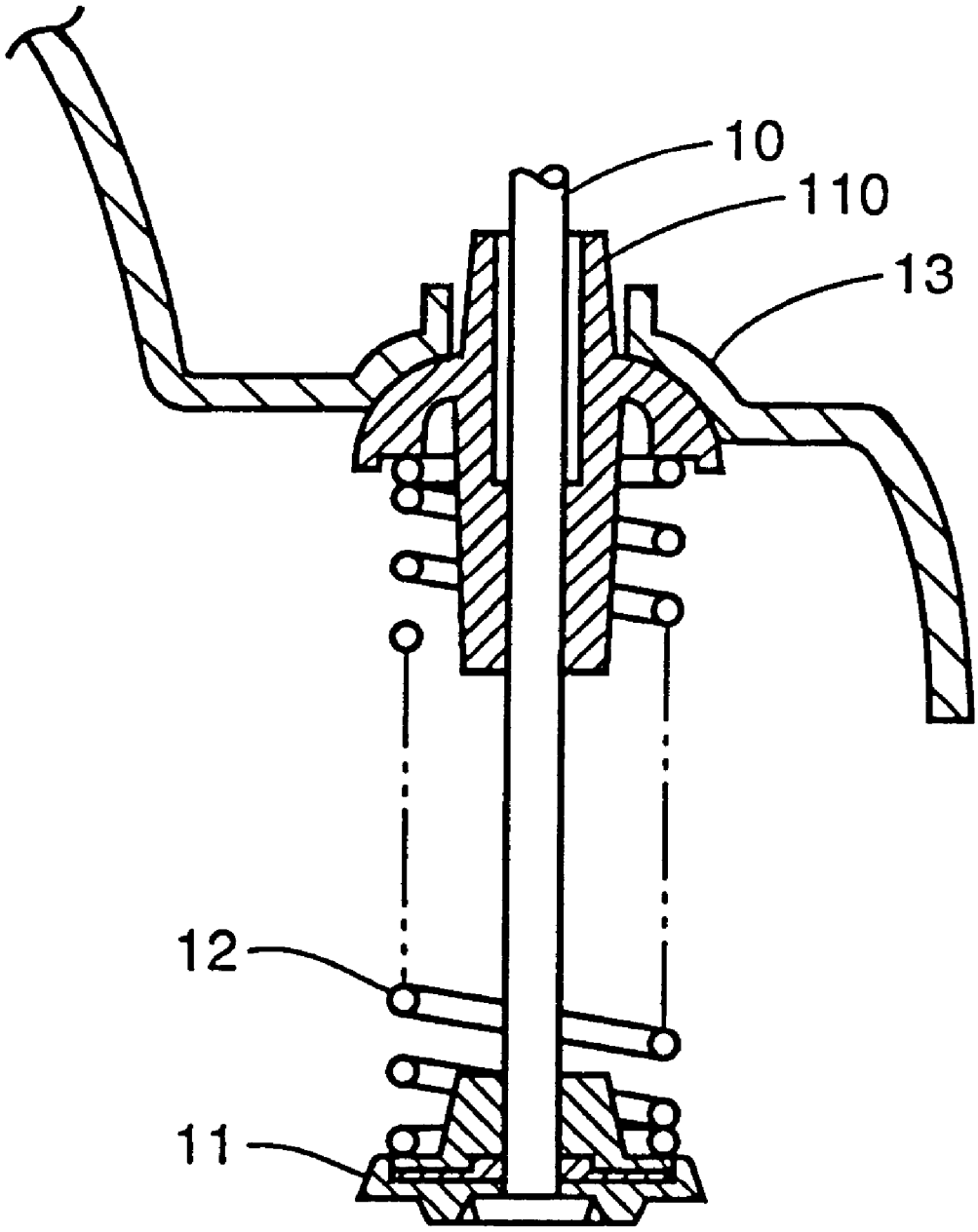
FIG. 14 is an enlarged cross section of the support receiving portion and the dumper portion of the drum washer-drier in accordance with a fifth embodiment.

FIG. 14 shows a structure near the support receiving portion 13 of the drum washer-drier in accordance with the fifth embodiment. Other portions of the washing machine in accordance with the fifth embodiment are the same as the corresponding portions of the washing machine in accordance with the first embodiment.

Referring to FIG. 14, in the washing machine in accordance with the fifth embodiment, in place of dumper 15 shown in FIG. 4, a dumper 110 is provided which has an opening through which suspending rod 10 is inserted, and generating sliding resistance between the outer peripheral surface of suspending rod 10 and the inner peripheral surface of the opening. The dumper 110 also provides the same effect as the first embodiment.

Both in the first and fifth embodiments, dumpers generating sliding resistance by sliding between the outer peripheral edge of the spring receiving portion 11 or the outer peripheral surface of suspending rod 10 have been described. However, such a dumper generating sliding resistance is not the only option. For example, a dumper utilizing viscous resistance of a fluid, or an air dumper utilizing temporarily repulsion of air may be used.

Sixth Embodiment

Figure 15:
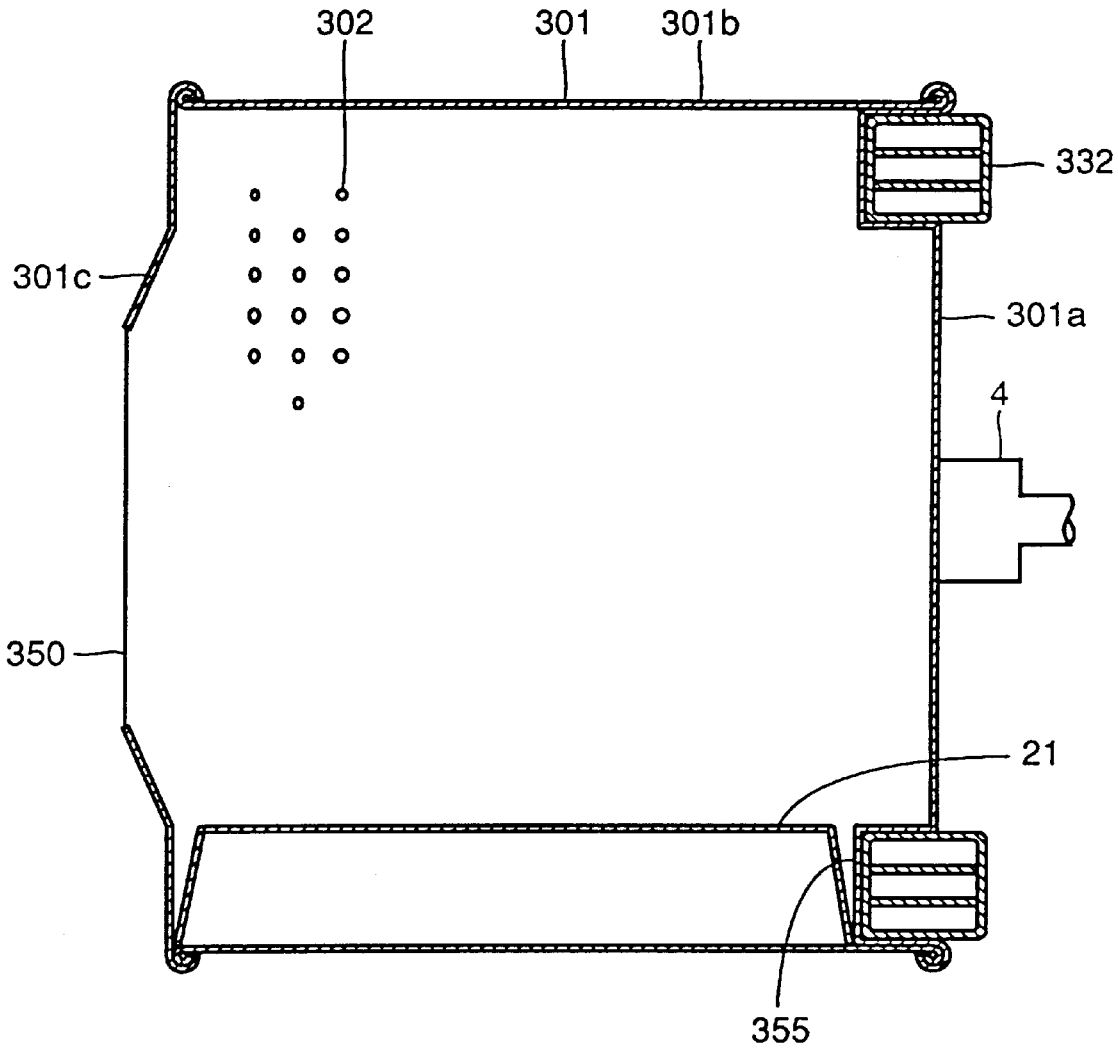
FIG. 15 is a cross section of the drum of a drum washer-drier in accordance with a sixth embodiment.

The drum washer-drier in accordance with a sixth embodiment will be described with reference to FIG. 15. The drum washer-drier is characterized by its drum. Referring to FIG. 15, drum 301 of the drum washer-drier in accordance with the sixth embodiment formed of metal includes a drum body 301*b* having a number of small holes 302 formed on its outer periphery, a drum bottom 301*a* on which a horizontal rotary axis 4, is fixed and lid 301*c* having an opening 350, and it is characterized in that a groove 355 is formed parallel to the rotary axis 4, along rotary axis 4 at drum bottom 301*a,* and that fluid balancer 332 is fitted in and fixed by the groove 355. Drum 301 is rotatably supported at one end on the surface of drum bottom 301*a* by rotary axis 4. Therefore, the further the center of gravity of rotation from the drum bottom 301*a,* the larger the moment on rotary axis 4 caused by fluid balancer 332 or drum 301, because of eccentricity of the center of gravity of the drum. However, as the fluid balancer 332 is fixed on drum bottom 301*a,* the moment can be made smaller. Therefore, vibration of drum 301 and hence vibration of water tank 3 can be reduced.

Seventh Embodiment

Figure 16:
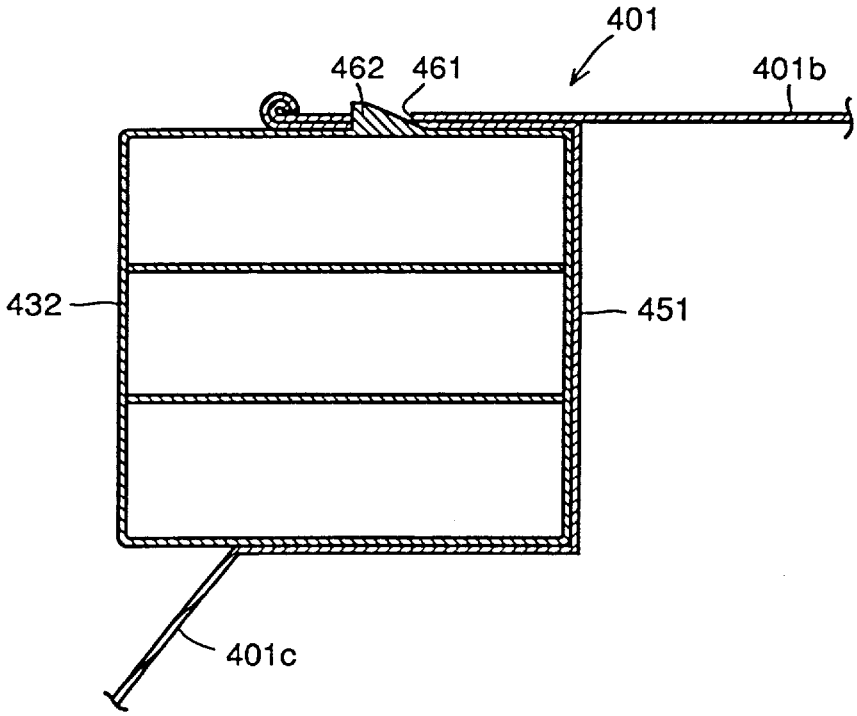
FIG. 16 is an enlarged cross section of an outer peripheral portion of the drum of the drum washer-drier in accordance with a seventh embodiment.

Referring to FIG. 16, the drum washer-drier in accordance with the seventh embodiment is characterized by the method of fixing fluid balancer 432 on drum 41. In FIG. 16, drum body 401*a* and drum lid 401*c* correspond to drum body 1*b* and drum lid 1*c* of the first embodiment shown in FIG. 3. Further, on the outer peripheral surface of drum lid 401*c,* a groove 451 is formed along the central axis of drum 401, and fluid balancer 432 is fitted in groove 451, as in the first embodiment.

The drum washer-drier in accordance with the seventh embodiment is characterized by the following. On the outer wall of groove 451 formed on drum lid 401*c,* a plurality of rectangular holes 461 are formed. On the outer periphery of fluid balancer 432, convex portions 462 are formed, corresponding to the plurality of rectangular holes 461. When fluid balancer 432 is fit in groove 451, the plurality of convex portions 462 are fitted in the corresponding rectangular holes 461. Therefore, movement of fluid balancer 432 in the axial direction of drum 401 is regulated, and fluid balancer 432 is fixed on drum 401. This structure has an effect that fluid balancer 432 can be fixed by quite simple a structure.

Eighth Embodiment

Figure 17:
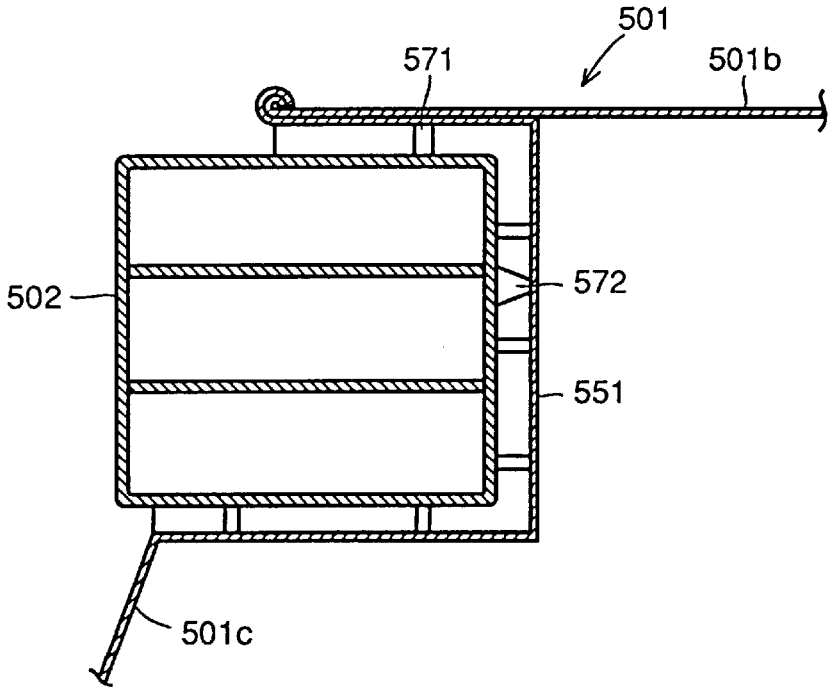
FIG. 17 is an enlarged cross section of the drum and fluid balancer of the drum washer-drier in accordance with an eighth embodiment.

Referring to FIG. 17, the feature of a drum washer-drier in accordance with an eighth embodiment of the present invention will be described. This washing machine is characterized by the method of fixing fluid balancer 502 on drum 501. Drum 501, drum body 501*b,* drum lid 501*c* and groove 511 shown in FIG. 17 correspond to drum 1, drum body 1*b,* drum lid 1*c* and groove 51 of the first embodiment shown in FIG. 3. In this washing machine, ribs 571 are formed on a peripheral surface of fluid balancer 502, and further a boss 572 is formed at the bottom surface. Height of the rib 571 is selected such that when fluid balancer 502 is inserted in groove 551, fluid balancer 502 is fixed stably.

Referring to FIG. 17, by fixing fluid balancer 502 on drum 501 by rib 571 or boss 572, the area of contact between fluid balancer 502 and drum 501 becomes very small. At other portions, there is formed an air layer between drum 501 and fluid balancer 502. Therefore, fluid transmitted from drum 501 to fluid balancer 502 as a whole can be reduced. Therefore, possibility of thermal deformation of fluid balancer 502 can be reduced.

Ninth Embodiment

Figure 18:
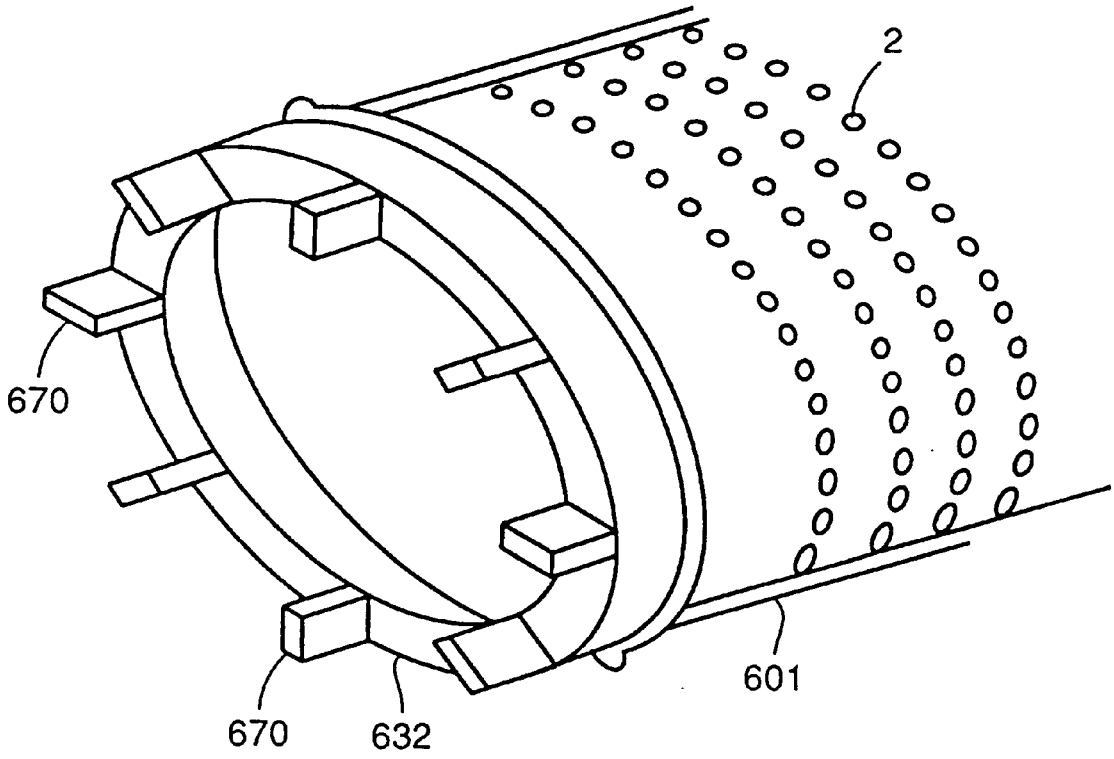
FIG. 18 is a perspective view of the drum and the fluid balancer of the drum washer-drier in accordance with a ninth embodiment.
Figure 19:
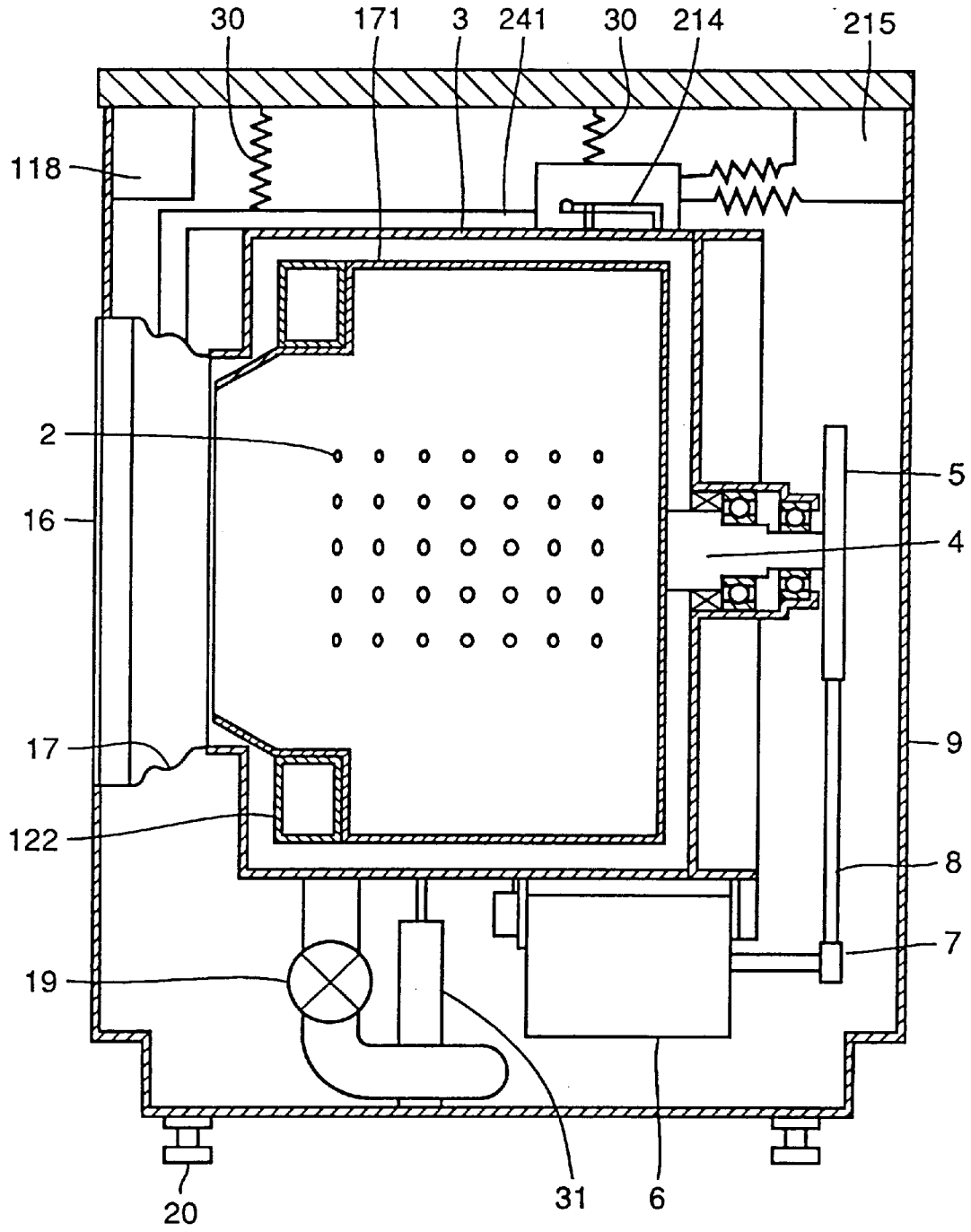
FIG. 19 PRIOR ART
FIG. 19 is a cross section of a first example of a conventional drum-drier.
Figure 20:
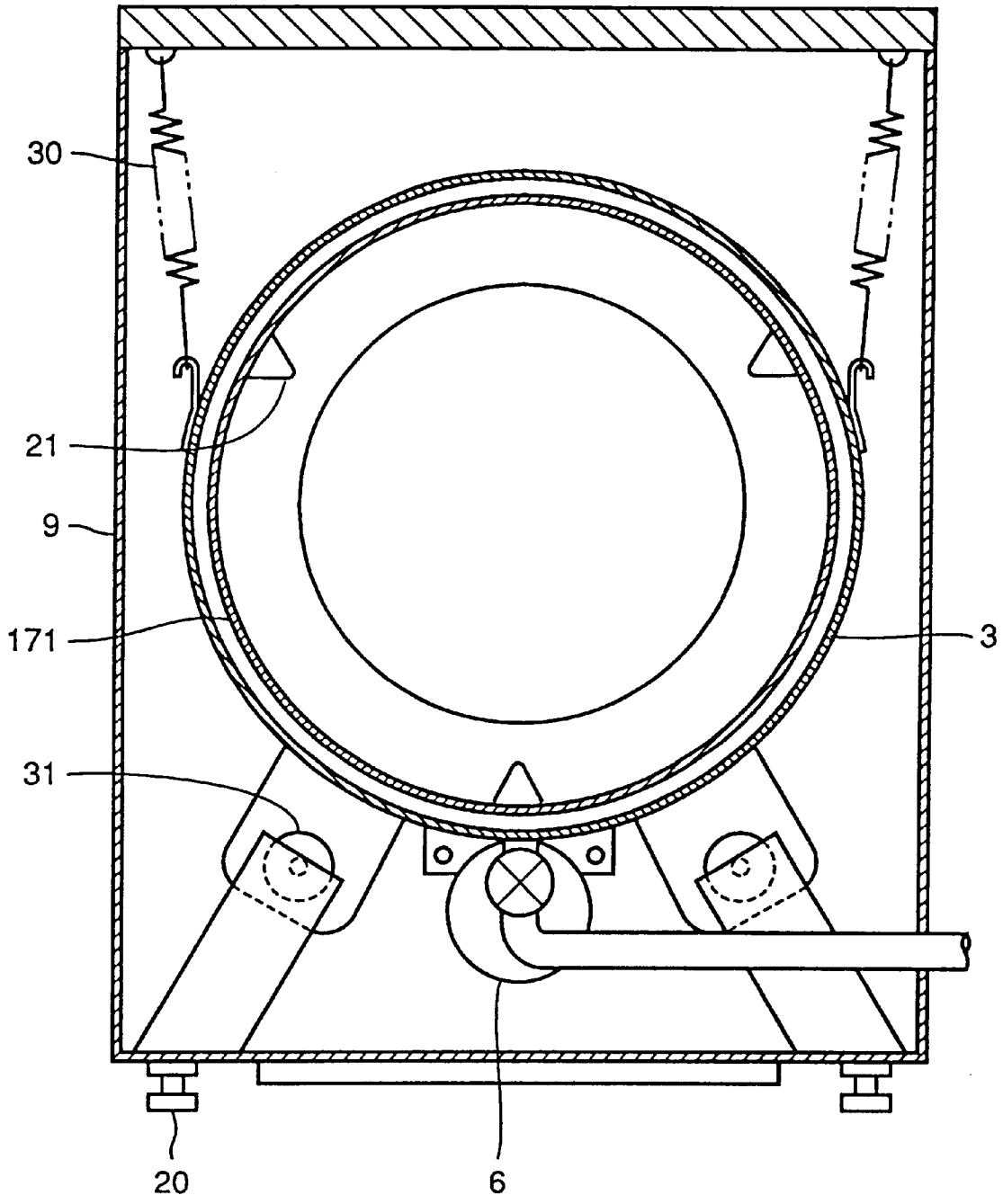
FIG. 20 PRIOR ART
FIG. 20 is a cross section taken along the front surface of the first example of the conventional drum washer-drier.
Figure 21:
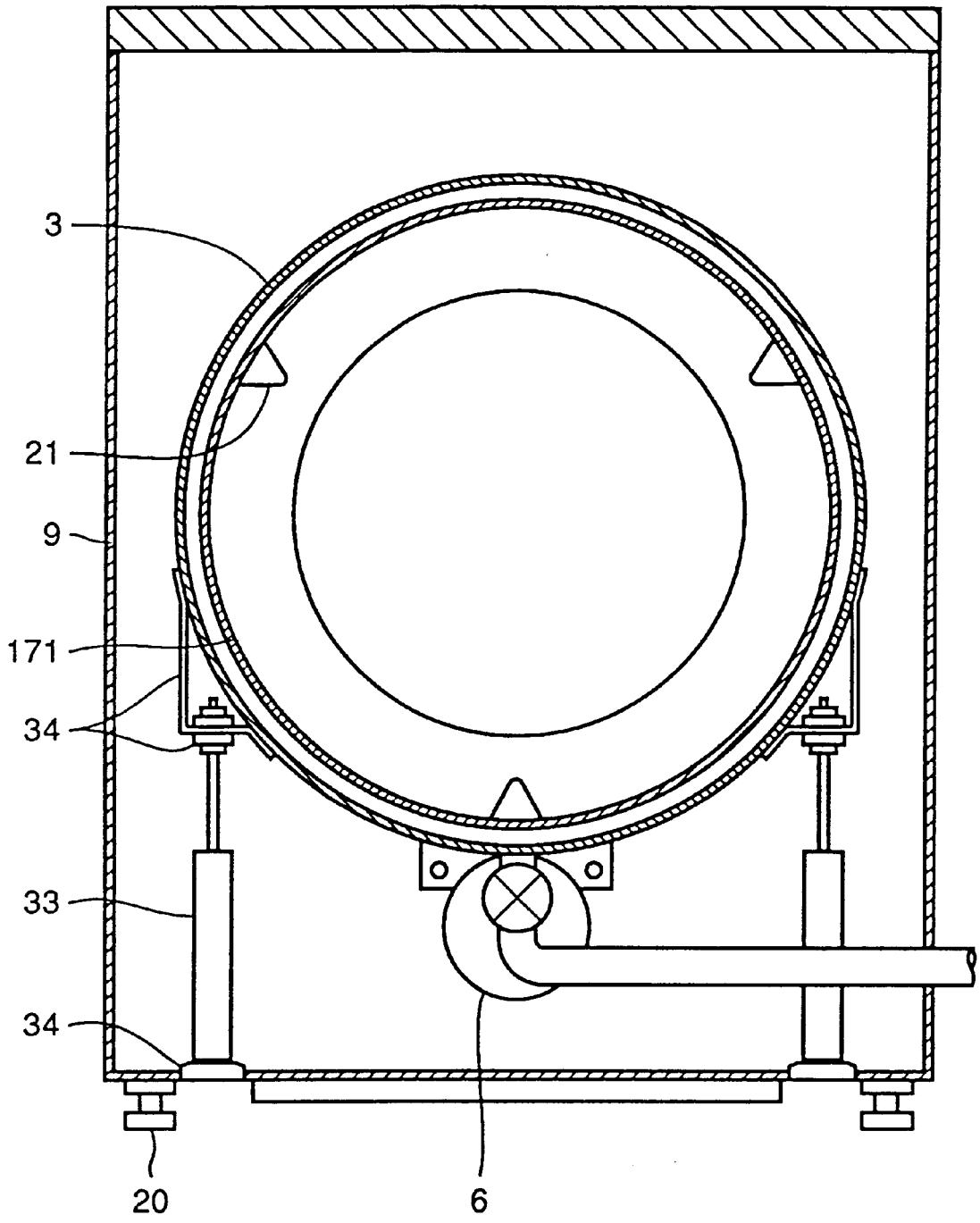
FIG. 21 PRIOR ART
FIG. 21 is a cross section taken along the front surface of a second example of the conventional drum washer-drier.
Figure 22:
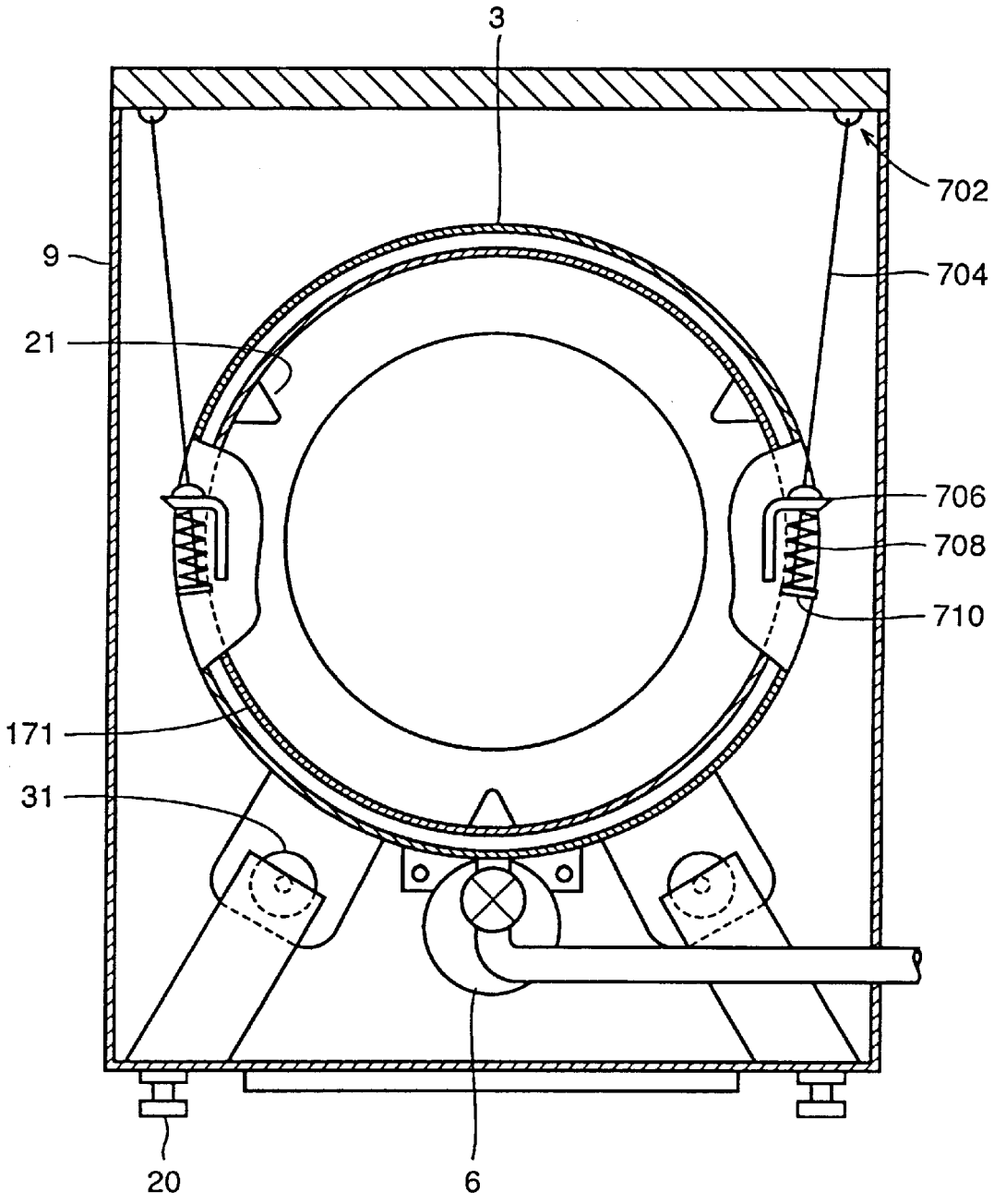
FIG. 22 PRIOR ART
FIG. 22 is a cross section taken along the front surface of a third example of the conventional drum washer-drier.

FIG. 18 is a perspective view of a drum 601 in the drum washer-drier in accordance with the ninth embodiment of the present invention. The drum 601 may be used combined with any of the drum washer-driers in accordance with the first to eighth embodiments above.

Referring to FIG. 18, drum 601 has a number of small holes 2 therearound, and fluid balancer 632 having a ring-shaped is fixed on the drum lid portion. On a surface of fluid balancer 632 opposite to the drum 601, a plurality of ribs 670 having its height along the axial direction of drum 601, its width along the radial direction and thickness along the peripheral direction are formed. By rotating drum 601 during the drying and dehydrating steps described above, ribs 670 provide a fan. By this fan, air around fluid balancer 632 is stirred, so that fluid balancer 632 is cooled. By this cooling, deformation of fluid balancer 632 can be prevented and vibration of drum 1 and water tank 3 during drying and dehydration can be prevented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A drum washer-drier, comprising:

a drying drum formed of a metal, rotatable about a prescribed axis and having a front surface and rear surface along said axis and a circular opening at said front surface, and a motor operatively coupled to said rotation axis; wherein said drum has a ring-shaped groove having an outer sidewall, an inner side wall and a bottom surface, formed on at least one of said front and rear surfaces;

said drum washer-drier further comprising a ring shaped fluid balancer fitted in said groove such that an outer side surface is supported by said outer and inner side walls.

2. The drum washer-drier according to claim 1, wherein said outer side wall has a plurality of rectangular holes, and said fluid balancer has a plurality of convex portions fittable in said rectangular holes, formed at positions corresponding to said rectangular holes on the outer side surface.

3. The drum washer-drier according to claim 2, wherein said fluid balancer has a front surface facing outward when said fluid balancer is fitted in said groove, and said balancer has a plurality of ribs formed on said front surface.

4. The drum washer-drier according to claim 1, wherein said fluid balancer includes a ring-shaped body having an outer side surface, an inner side surface, a bottom surface and a front surface of a size insertable in said groove with a space therebetween, and a plurality of projections formed on said inner side surface and said bottom surface, having a prescribing height necessary for fixing said ring-shaped body in said groove.

5. The drum washer-drier according to claim 4, wherein said outer side surface has a plurality of rectangular holes, and said fluid balancer has a plurality of convex portions fittable in said rectangular holes, formed at positions corresponding to said rectangular holes, on the outer side surface.

6. The drum washer-drier according to claim 1, wherein said outer side surface has a plurality of rectangular holes, and said fluid balancer has a plurality of convex portions fittable in said rectangular holes, formed at positions corresponding to said rectangular holes, on the outer side surface.

7. A method of operating a drum washer-drier including a washing and drying drum rotating about an approximately horizontal axis, a fluid balancer rotating integrally with said drum, a water tank enclosing said drum, an outer tank resiliently supporting said water tank therein, a motor driving said drum, and a control circuit for controlling said drum, for rotating said drum to dry laundry by software control by said control circuit, said method comprising a low speed rotation step in which said motor is controlled such that said drum is rotated at a prescribed rotation speed higher than critical rotation speed of said fluid balancer and lower than resonance rotation speed generated by resilient support for a prescribed time period, and a step of high speed rotation in which said motor is controlled such that after said drum is rotated for said prescribed time period at said prescribed rotation speed, said drum is rotated at a predetermined prescribed high rotation speed for dehydration.

8. The method of operating a drum washer-drier according to claim 7, further comprising:

after said step of low speed rotation and before said step of high speed rotation, the step of controlling said motor such that said drum is rotated for a prescribed time period at a rotation speed higher than said prescribed rotation speed of said drum in said low rotation speed step and lower than the resonance rotation speed generated by said resilient support.

9. The method of operating a drum washer-drier according to claim 8, wherein said drum washer-drier further includes a vibration sensor attached on said water tank, said method further comprising the steps of determining, prior to start of said high speed rotation step, whether a value detected by said vibration sensor is not lower than a predetermined value or not; and determining whether said high speed rotation step is to be started or control is to be returned to said low speed rotation step, in accordance with result of said determination.

10. The method of operating a drum washer-drier according to claim 7, wherein a plurality of different rotation speeds each being higher than said critical rotation speed of said fluid balancer and lower than the resonance rotation speed generated by said resilient support are selected in advance, and said step of low speed rotation includes the step of controlling said motor such that said drum is rotated at a prescribed time period by selecting lowest rotation speed of said plurality of different rotation speeds;

next stage of rotation in which said motor is controlled such that said drum is rotated for a prescribed time period by selecting a rotation speed immediately higher than the rotation speed selected in the last step; and repeating said next stage of rotation until the step in which drum is rotated at the highest rotation speed of said plurality of different rotation speeds is completed.

11. The method of operating a drum washer-drier according to claim 10, wherein said drum washer-drier further includes a vibration sensor attached on said water tank, said method further comprising the steps of determining, prior to start of said high speed rotation step, whether a value detected by said vibration sensor is not lower than a predetermined value or not; and determining whether said high speed rotation step is to be started or control is to be returned to said low speed rotation step, in accordance with result of said determination.

12. The method of operating a drum washer-drier according to claim 7, wherein said drum washer-drier further includes a vibration sensor attached on said water tank, said method further comprising the steps of determining, prior to start of said high speed rotation step, whether a value detected by said vibration sensor is not lower than a predetermined value or not; and determining whether said high speed rotation step is to be started or control is to be returned to said low speed rotation step, in accordance with result of said determination.

* * * * *